US011261003B2

(12) United States Patent
Theiss, III et al.

(10) Patent No.: US 11,261,003 B2
(45) Date of Patent: Mar. 1, 2022

(54) PACKAGE WITH RAISED PORTIONS

(71) Applicant: The Procter & Gamble Company, Cincinnati, OH (US)

(72) Inventors: Edward Daniel Theiss, III, Union Township, KY (US); Teofilo Medellin, Loveland, OH (US); Hugh Joseph O'Donnell, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 15/451,870

(22) Filed: Mar. 7, 2017

(65) Prior Publication Data

US 2019/0039777 A1 Feb. 7, 2019

Related U.S. Application Data

(60) Provisional application No. 62/306,124, filed on Mar. 10, 2016.

(51) Int. Cl.
*B65D 5/42* (2006.01)
*B65D 75/52* (2006.01)
(Continued)

(52) U.S. Cl.
CPC ..... *B65D 5/4225* (2013.01); *B65D 65/18* (2013.01); *B65D 65/22* (2013.01); *B65D 65/406* (2013.01);
(Continued)

(58) Field of Classification Search
CPC ..... B65D 75/52; B65D 5/4225; B65D 65/18; B65D 65/22; B65D 65/406;
(Continued)

(56) References Cited

U.S. PATENT DOCUMENTS 2,084,026 A 6/1937 Irving
2,235,791 A * 3/1941 Wohlers ..... B65D 65/22 283/81
(Continued)

FOREIGN PATENT DOCUMENTS

CN 1685099 10/2005
WO 2007122524 11/2007

OTHER PUBLICATIONS

Anonymous: "Products—Diapers & Wipes", Pampers, Oct. 25, 2015, XP002769271, Retrieved from the Internet: URL:http://www.pampers.com/en-US/diapers-wipes [retrieved on Apr. 13, 2017] figures.
(Continued)

*Primary Examiner* — Chun Hoi Cheung
*Assistant Examiner* — Brijesh V. Patel
(74) *Attorney, Agent, or Firm* — Daniel S. Albrecht; Andrew J. Mueller

(57) ABSTRACT

Flexible packages for retail sale of rolled tissue products are provided. The flexible package may include a raised area having an overall height of 40-5000 microns disposed on an outside of the package. The raised area may be a separate element from the flexible package. The flexible package may contain at least one rolled tissue product. The rolled tissue product may have a visible pattern of embossing. The flexible package may have a portion thereof that is sufficiently transparent sufficient to enable seeing the visible pattern of embossing. The flexible package may have a portion thereof that is opaque, such that portions of the rolled tissue product cannot be seen from outside of the package.

20 Claims, 19 Drawing Sheets

(51) Int. Cl.
*B65D 65/18* (2006.01)
*B65D 65/22* (2006.01)
*B65D 65/40* (2006.01)
*G09F 23/12* (2006.01)

(52) U.S. Cl.
CPC ..... *B65D 75/52* (2013.01); *B65D 75/522* (2013.01); *G09F 23/12* (2013.01); *B65D 2203/00* (2013.01); *B65D 2203/02* (2013.01)

(58) Field of Classification Search
CPC .... B65D 2203/02; B65D 85/00; B65D 25/24; B65D 5/62; B65D 5/4212; B65D 5/4216; B65D 5/425; B65D 5/42; B65D 25/00; B65D 85/672; G09F 23/12; A61F 13/551; B65H 16/06
USPC .... 206/459.5, 494, 440, 439, 210, 769, 778, 206/395, 596.8; 40/616, 596; 229/87.01, 229/87.06
See application file for complete search history.

(56) References Cited

U.S. PATENT DOCUMENTS 2,482,094 A 9/1949 Chavannes
2,575,046 A 11/1951 Chavannes
2,917,223 A 12/1959 Le Bolt
3,024,154 A 3/1962 Singleton et al.
3,283,992 A 11/1966 Hanson
3,411,698 A 11/1968 Reynolds
3,629,380 A * 12/1971 Edwards ..... B41M 1/125 264/53
3,636,147 A 1/1972 Rowland
3,832,267 A 8/1974 Liu
4,127,689 A 11/1978 Holt
4,536,362 A 8/1985 Donaldson
4,629,643 A 12/1986 Curro
4,781,880 A 11/1988 Robbins, III
4,816,316 A 3/1989 Robbins, III
4,859,519 A 8/1989 Cabe
4,933,218 A * 6/1990 Longobardi ..... B41M 1/34 101/487
5,082,703 A * 1/1992 Longobardi ..... B41M 1/34 40/615
5,158,819 A 10/1992 Goodman
5,407,711 A * 4/1995 Lovison ..... B41M 3/008 101/211
5,693,405 A 12/1997 Harvie
5,733,617 A 3/1998 Baduel
5,968,607 A * 10/1999 Lovison ..... B41M 7/0027 101/177
6,113,149 A * 9/2000 Dukatz ..... B42D 15/00 283/109
6,170,881 B1 1/2001 Salmon et al.
6,520,330 B1 2/2003 Batra
6,541,561 B1 4/2003 Lythgoe
6,746,053 B1 * 6/2004 Afzali-Ardakani ..... G06K 19/06028 206/459.5
6,949,290 B2 * 9/2005 Schaeffeler ..... B29C 59/18 427/280
6,979,487 B2 * 12/2005 Scarbrough ..... B41M 1/18 101/211
7,131,380 B2 * 11/2006 Hutter ..... B41M 3/008 101/491
7,185,453 B2 3/2007 Spear
7,291,447 B2 11/2007 Silverbrook
7,403,309 B2 * 7/2008 Moncrieff ..... B44C 1/105 358/3.12
7,497,475 B1 * 3/2009 Reindl ..... B42D 15/02 283/91
7,846,501 B2 * 12/2010 Benson ..... B41M 1/18 427/265
8,136,664 B2 3/2012 Benson et al.
8,220,632 B2 7/2012 Oi et al.
8,637,727 B2 1/2014 Maldonado et al.
8,637,737 B2 1/2014 Van Roggen et al.
8,758,865 B2 * 6/2014 Belelie ..... B41M 3/16 427/511
9,044,353 B2 6/2015 Stone
9,235,126 B1 1/2016 Bielak
9,242,270 B2 1/2016 Guigan
9,271,879 B2 3/2016 Stone
9,546,277 B2 1/2017 Cobler
9,693,043 B2 6/2017 Lin
9,809,348 B2 * 11/2017 Smalley ..... B65D 5/0227
9,815,258 B2 11/2017 Stanley et al.
10,076,451 B2 9/2018 Giovanni et al.
2002/0023708 A1 2/2002 Tronchetti
2003/0067157 A1 4/2003 McKillip
2003/0120241 A1 6/2003 Sorebo
2004/0121120 A1 6/2004 Gray
2004/0234306 A1 11/2004 Gheer et al.
2005/0279579 A1 12/2005 Milk
2006/0168914 A1 8/2006 Steeves-Kiss
2006/0195357 A1 8/2006 Klofta
2006/0201841 A1 * 9/2006 Mohr ..... B65D 83/0841 206/395
2007/0235263 A1 10/2007 Legault
2008/0000793 A1 1/2008 Messerschmidt
2008/0098630 A1 * 5/2008 Frankenbach ..... G09F 3/00 40/312
2008/0128308 A1 6/2008 Betts
2008/0245491 A1 10/2008 Knobloch et al.
2008/0277295 A1 * 11/2008 Benson ..... A61F 13/551 206/210
2009/0019741 A1 * 1/2009 Schwartz ..... G09F 3/00 40/312
2009/0065560 A1 3/2009 Johnson
2010/0155274 A1 * 6/2010 de The ..... B31F 1/07 206/271
2010/0201024 A1 8/2010 Gibson
2011/0000802 A1 * 1/2011 Weiss ..... B65D 5/4212 206/242
2011/0103072 A1 5/2011 Jones et al.
2011/0108455 A1 * 5/2011 Aldridge ..... B65D 71/063 206/778
2011/0117307 A1 5/2011 Fraser
2011/0221094 A1 9/2011 Gross
2011/0250320 A1 * 10/2011 Dechert ..... B65D 5/4216 206/459.5
2011/0255073 A1 * 10/2011 Brill ..... B05D 3/0209 356/51
2012/0057811 A1 3/2012 Tucker
2012/0063706 A1 3/2012 Fraser
2012/0160722 A1 * 6/2012 Anderson ..... B65D 65/14 206/410
2012/0215190 A1 8/2012 Kawashima
2012/0269466 A1 10/2012 Dorsey
2012/0288669 A1 * 11/2012 Gatos ..... B29C 48/20 428/137
2014/0155850 A1 6/2014 Shah et al.
2015/0210468 A1 * 7/2015 Stephens ..... A47K 10/42 206/229
2016/0045380 A1 2/2016 Cree
2016/0221379 A1 8/2016 Namba et al.
2017/0259961 A1 9/2017 O'Donnell
2017/0259971 A1 9/2017 O'Donnell
2017/0259972 A1 9/2017 O'Donnell

OTHER PUBLICATIONS

All Office Actions for U.S. Appl. No. 15/451,445.
All Office Actions for U.S. Appl. No. 15/451,446.
All Office Actions for U.S. Appl. No. 15/451,449.
Search Report and Written Opinion for PCT/US2017/021734 dated Apr. 28, 2017.
PCT Preliminary Rept on Patentability dated Sep. 11, 2018.
Kipphan, Helmut, Handbook of Print Media, Technologies and

(56) References Cited

OTHER PUBLICATIONS

Production Methods, Berlin, Springer, 2001, pp. 397-398 (Year: 2001).
Flexographic Technical Association, Flexography: Principles and Practices, 5th Edition, Huntington Station, New York, vol. 1. 2000 pp. 3-5 (Year: 2000).

* cited by examiner

PACKAGE WITH RAISED PORTIONS

FIELD

The present disclosure relates in general to packages and in particular to packages having raised portions.

BACKGROUND

Packages for consumer products often have external artwork that includes graphics, such as images and branding. However, there are certain challenges to effectively displaying such graphics. It is difficult for any particular package to stand out from other packages, on a store shelf. Flexible packages are prone to bending and wrinkling, which can cause artwork on the packages to have a poor appearance. Some packages are opaque, which prevents consumers from seeing the consumer product(s) inside of the package. And, when one company offers consumer products in different forms and/or different types of packages, consumers may not easily understand the similarities and differences between the offerings.

SUMMARY

Packages of the present disclosure provide improvements in displaying graphics, such as images and branding.

In various embodiments, described herein, one or more raised areas can be disposed on one or more portions of a package. Also, graphics may be associated with these raised areas, by being partially or fully disposed within, upon, around, between, among, or adjacent to the raised areas. For a package having graphics associated with raised area(s), the graphics become more noticeable, due to their association with a relatively higher surface, with respect to other portions of the package. For a flexible package, having graphics disposed on raised area(s), the graphics can become even more noticeable, due to the fact that the raised area(s) tend to be relatively flat surfaces, which better resist bending and/or wrinkling that may be present on other portions of the flexible package. For an opaque package that contains a consumer product, when an image of the consumer product is associated with a raised area, that combination can portray a characteristic (e.g. size, shape, texture) of the consumer product, better than a graphic that is not associated with a raised area. One or more raised areas that are shaped according to graphics, such as images and branding, may also be used as a form of secondary communication that is separate from and in addition to other (unrelated) artwork and/or graphics that are printed over such raised areas. Since these packages have more noticeable graphics, a line-up of such packages can more clearly emphasize similarities and/or differences between product offerings. For each of these reasons, packages that have raised areas provide better visual communication, and can stand out from conventional packages.

In various embodiments, described herein, one or more raised reinforcing lines can be disposed on one or more portions of a package. Also, raised reinforcing lines may partially or fully surround one or more raised areas. For a flexible package having raised reinforcing lines disposed on a flexible portion of the package, the raised reinforcing lines can increase the stiffness in that portion. The increased stiffness can at least assist in reducing bending and/or wrinkling of the package in the portion. Reduced bending and/or wrinkling improves the appearance of the package, allows graphics to be more easily noticed and understood, and provides better package stability. The raised reinforcing lines can also draw further attention to graphics by providing a contrasting background and/or by using their shapes and/or patterns to bring focus to one or more particular portions of the package. For each of these reasons, packages that have raised reinforcing areas offer improved appearance, provide better visual communication, and can stand out from conventional packages.

DETAILED DESCRIPTION

The embodiments described herein include raised areas and/or raised reinforcing lines that may be formed in any way described herein or known in the art. The raised areas and/or raised reinforcing lines may be disposed on any portion of any kind of package or packaging material described herein or known in the art. While these embodiments disclose raised areas and/or raised reinforcing lines having particular shapes, these particular shapes are not required; part, parts, or all or any raised area (including any inner portion and any outer portion) and/or any raised reinforcing line (including any individual line shape, any end profile shape, and/or any reinforcing pattern) can have any shape described herein or known in the art.

The embodiments described herein also include graphics that may be applied in any way described herein or known in the art. Part, parts, or all of any of the graphics described herein can be applied as an integral part of a raised area or as a separate element, disposed beneath, within, or on top of a raised area. While these embodiments disclose graphics having particular forms, these particular forms are not required; part, parts, or all or any graphics can have any form described herein or known in the art.

For any embodiment described herein, and for each raised reinforcing area disposed on a package, part, parts, or all of the raised area may be repeated in a same or similar form on one or more other portions/panels of the package or may be repeated in a same or similar form one or more other packages in a line-up of packages.

Figure 1A:
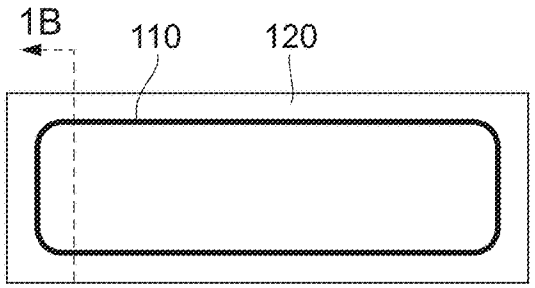
FIG. 1A illustrates a front view of branding disposed on raised areas.
Figure 1B:
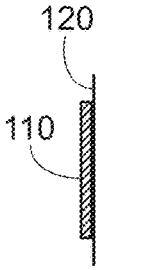
FIG. 1B illustrates a cross-section of FIG. 1A, the cross-section taken through line 1B-1B.
Figure 1C:
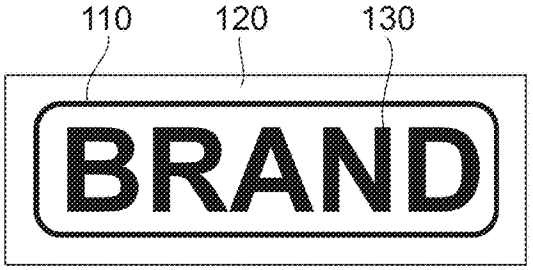
FIG. 1C illustrates a front view of branding disposed on raised areas.

FIG. 1A illustrates a front view of a rectangular raised area 110 disposed on a portion of a package 120; FIG. 1B illustrates a cross-sectional view (from FIG. 1A) showing a continuous left-end portion of the raised area 110; and FIG. 1C illustrates a front view of branding 130 that is the text of the word BRAND, fully disposed on the raised area 110, wherein the raised area 110 is larger than the branding 130, and an overall shape of the raised area 110 is not related to an overall shape of the branding 130. In any of the embodiments disclosed herein, any graphic can be partially or fully disposed on one or more raised areas having an overall shape that is larger than and not related to an overall shape of the graphic, as described and illustrated in FIGS. 1A-1C.

Figure 2A:
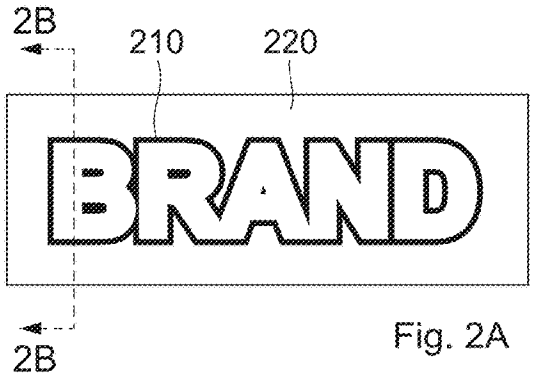
FIG. 2A_illustrates a front view of branding disposed on raised areas.
Figure 2B:
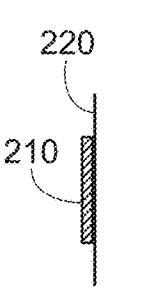
FIG. 2B illustrates a cross-section of FIG. 2A, the cross-section taken through line 2B-2B.

FIG. 2A illustrates a front view of a shaped raised area 210 disposed on a portion of a package 220; FIG. 2B illustrates a cross-sectional view (from FIG. 2A) showing a continuous left-end portion of the raised area 210; and FIG.

2C illustrates a front view of branding 230 that is the text of the word BRAND, fully disposed on the raised area 210, wherein the raised area 210 is larger than the branding 230, and wherein an overall outer shape of the raised area 210 is geometrically similar to an overall outer shape of the branding 230. In any of the embodiments disclosed herein, any graphics can be partially or fully disposed on one or more raised areas having an overall outer shape that is larger than and geometrically similar to an overall outer shape of the graphic, as described and illustrated in FIGS. 2A-2C.

Figure 3A:
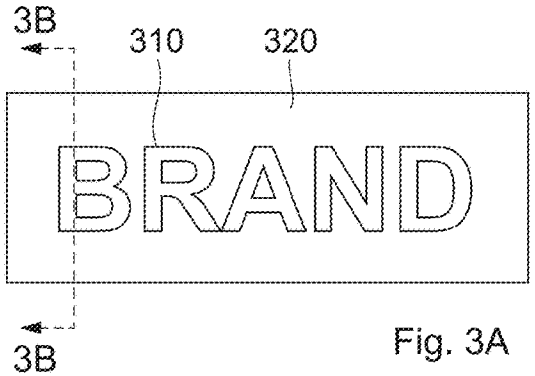
FIG. 3A_illustrates a front view of branding disposed on raised areas.
Figure 3B:
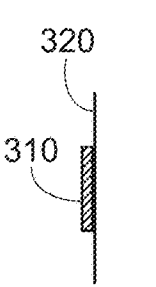
FIG. 3B illustrates a cross-section of FIG. 3A, the cross-section taken through line 2B-2B.
Figure 3C:
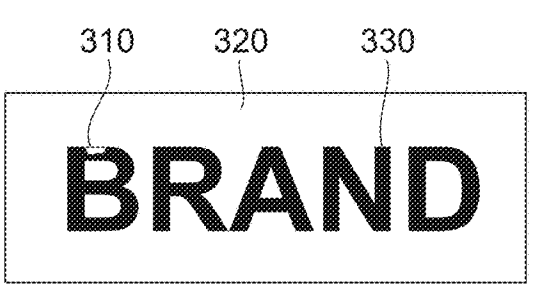
FIG. 3C illustrates a front view of branding disposed on raised areas.

FIG. 3A illustrates a front view of a raised area 310 disposed on a portion of a package 320; FIG. 3B illustrates a cross-sectional view (from FIG. 3A) showing a continuous left-end portion of the raised area 310; and FIG. 3C illustrates a front view of branding 330 that is text of the word BRAND, fully disposed on the raised area 310, wherein an overall outer shape of the raised area 310 conforms to an overall outer shape of the branding 330 (shown as partially broken). In any of the embodiments disclosed herein, any graphics can be partially or fully disposed on one or more raised areas having an overall outer shape that conforms to an overall outer shape of the graphic, as described and illustrated in FIGS. 3A-3C.

Figure 4A:
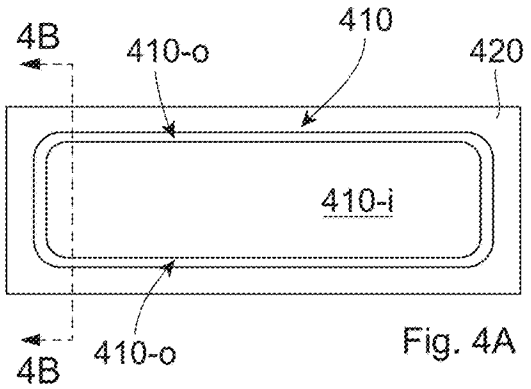
FIG. 4A illustrates a front view of branding disposed on raised areas with multiple heights.
Figure 4B:
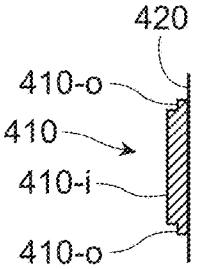
FIG. 4B illustrates a cross-section of FIG. 4A, the cross-section taken through line 4B-4B.
Figure 4C:
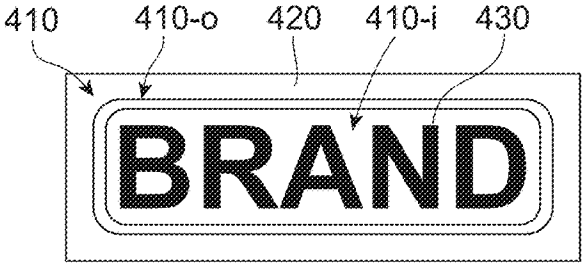
FIG. 4C illustrates a front view of branding disposed on raised areas.

FIG. 4A illustrates a front view of a raised area 410 wherein the raised area 410 has a rectangular outer portion 410-*o* and a rectangular inner portion 410-*i* and is disposed on a portion of a package 420; FIG. 4B illustrates a cross-sectional view (from FIG. 4A) showing a continuous left-end portion of the raised area 410, wherein the inner portion 410-*i* is relatively taller and the outer portion 410-*o* is relatively shorter; and FIG. 4C illustrates a front view of branding 430 that is text of the word BRAND, fully disposed on the inner portion 410-*a* of the raised area 410, wherein the inner portion 410-*a* of the raised area 410 is larger than the branding 430, and the overall shapes of the portions of the raised area 410 are not related to an overall shape of the branding 430. In any of the embodiments disclosed herein, any graphic, can be partially or fully disposed on one or more relatively taller inner portions of one or more raised areas having an overall shape that is larger than and not related to an overall shape of the graphic, as described and illustrated in FIGS. 4A-4C.

Figure 5A:
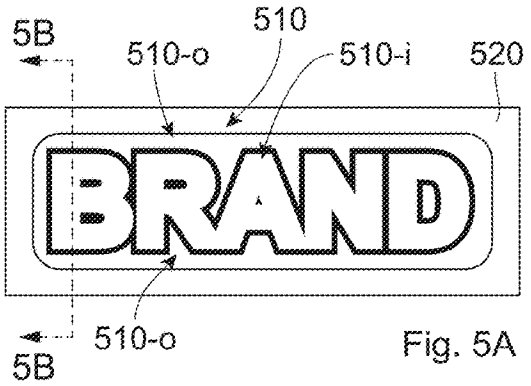
FIG. 5A illustrates a front view of branding disposed on raised areas with multiple heights.
Figure 5B:
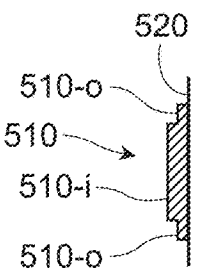
FIG. 5B illustrates a cross-section of FIG. 5A, the cross-section taken through line 5B-5B.
Figure 5C:
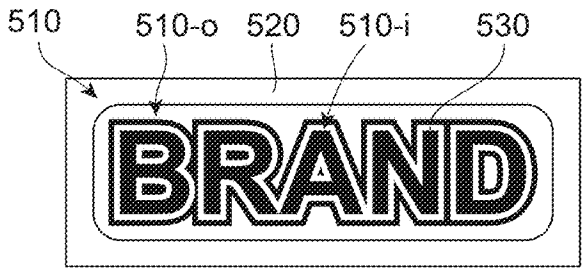
FIG. 5C illustrates a front view of branding disposed on raised areas with multiple heights.

FIG. 5A illustrates a front view of a raised area 510 wherein the raised area 510 has a rectangular outer portion 510-*o* and a shaped inner portion 510-*a* and is disposed on a portion of a package 520; FIG. 5B illustrates a cross-sectional view (from FIG. 5A) showing a continuous left-end portion of the raised area 510, wherein the inner portion 510-*a* is relatively taller and the outer portion 510-*o* is relatively shorter; and FIG. 5C illustrates a front view of branding 530 that is text of the word BRAND, fully disposed on the inner portion 510-*a* of the raised area 510, wherein the inner portion 510-*a* of the raised area 510 is larger than the branding 530, wherein an overall outer shape of the inner portion 510-*a* is geometrically similar to an overall outer shape of the branding 530, and an overall shape of the outer portion 510-*o* is not related to an overall shape of the branding 530. In any of the embodiments disclosed herein, any graphic, can be partially or fully disposed on one or more relatively taller inner portions of one or more raised areas having an overall shape that is larger than and geometrically similar to an overall shape of the graphic, as described and illustrated in FIGS. 5A-5C.

Figure 6A:
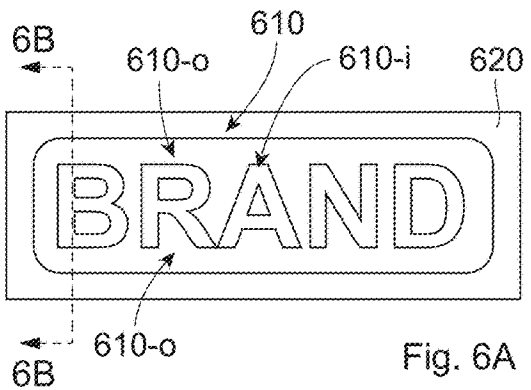
FIG. 6A illustrates a front view of branding disposed on raised areas with multiple heights.
Figure 6B:
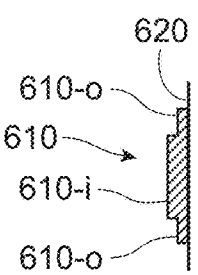
FIG. 6B illustrates a cross-section of FIG. 6A, the cross-section taken through line 6B-6B.
Figure 6C:
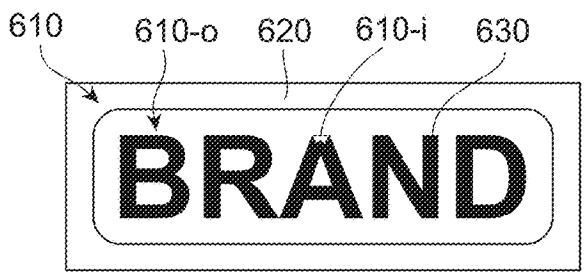
FIG. 6C illustrates a front view of branding disposed on raised areas with multiple heights.

FIG. 6A illustrates a front view of a raised area 610 wherein the raised area 610 has a rectangular outer portion 610-*o* and a shaped inner portion 610-*a* and is disposed on a portion of a package 620; FIG. 6B illustrates a cross-sectional view (from FIG. 6A) showing a continuous left-end portion of the raised area 610, wherein the inner portion 610-*a* is relatively taller and the outer portion 610-*o* is relatively shorter; and FIG. 6C illustrates a front view of branding 630 that is text of the word BRAND, fully disposed on the inner portion 610-*a* of the raised area 610, wherein an overall outer shape of the inner portion 610-*a* conforms to an overall outer shape of the branding 630, and an overall shape of the outer portion 610-*o* is not related to an overall shape of the branding 630 (shown as partially broken). In any of the embodiments disclosed herein, any graphic, can be partially or fully disposed on one or more relatively taller inner portions of one or more raised areas having an overall shape that conforms to an overall shape of the graphic, as described and illustrated in FIGS. 6A-6C.

Figure 7A:
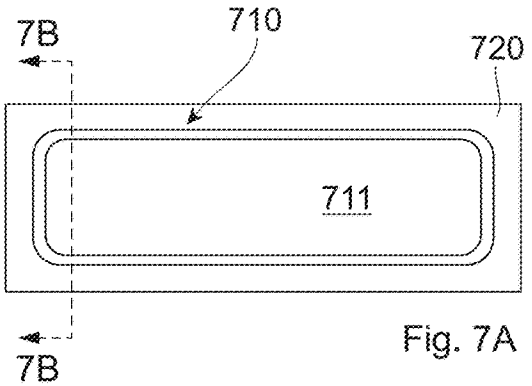
FIG. 7A_illustrates branding disposed on recessed areas within raised areas.
Figure 7B:
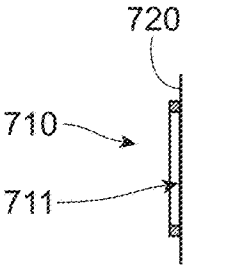
FIG. 7B illustrates a cross-section of FIG. 7A, the cross-section taken through line 7B-7B.
Figure 7C:
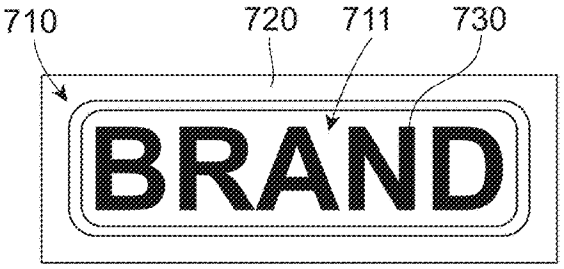
FIG. 7C illustrates a front view of branding disposed on recessed areas within raised areas.

FIG. 7A illustrates a front view of a raised area 710 wherein the raised area 710 forms a rectangular outline and an inner portion encloses a rectangular recessed area 711 disposed on a portion of a package 720; FIG. 7B illustrates a cross-sectional view (from FIG. 7A) showing a discontinuous left-end portion of the raised area 710, wherein the recessed area 711 is relatively shorter than the raised area 710; and FIG. 7C illustrates a front view of branding 730 that is text of the word BRAND, fully disposed on the recessed area 711 within the raised area 710, wherein the recessed area 711 is larger than the branding 730, and the overall shapes of the raised area 710 and the recessed area 711 are not related to an overall shape of the branding 730. In any of the embodiments disclosed herein, any graphic can be partially or fully disposed on one or more relatively shorter recessed portions within one or more raised areas, the recessed portions having an overall shape that is larger than and not related to an overall shape of the graphic, as described and illustrated in FIGS. 7A-7C.

Figure 8A:
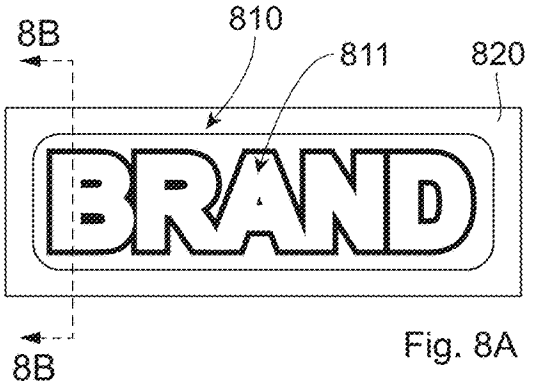
FIG. 8A illustrates a front view of branding disposed on recessed areas within raised areas.
Figure 8B:
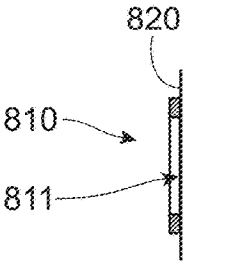
FIG. 8B illustrates a cross-section of FIG. 8A, the cross-section taken through line 8B-8B.
Figure 8C:
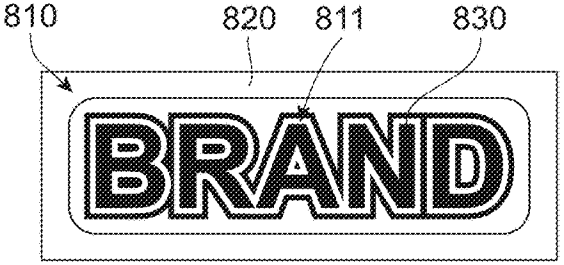
FIG. 8C illustrates a front view of branding disposed on recessed areas within raised areas.

FIG. 8A illustrates a front view of a raised area 810 wherein an overall outer shape of the raised area 810 is rectangular and an inner portion encloses a shaped recessed area 811 disposed on a portion of a package 820; FIG. 8B illustrates a cross-sectional view (from FIG. 8A) showing a discontinuous left-end portion of the raised area 810, wherein the recessed area 811 is relatively shorter than the raised area 810; and FIG. 8C illustrates a front view of branding 830 that is text of the word BRAND, fully disposed on the recessed area 811 within the raised area 810, wherein the recessed area 810 is larger than the branding 830, wherein an overall shape of the recessed area 811 is geometrically similar to an overall outer shape of the branding 830, and an overall outer shape of the raised area 810 is not related to an overall shape of the branding 830. In any of the embodiments disclosed herein, any graphic can be partially or fully disposed on one or more relatively shorter recessed portions within one or more raised areas, the recessed portion(s) having an overall shape that is larger than and geometrically similar to an overall shape of the graphic, as described and illustrated in FIGS. 8A-8C.

Figure 9A:
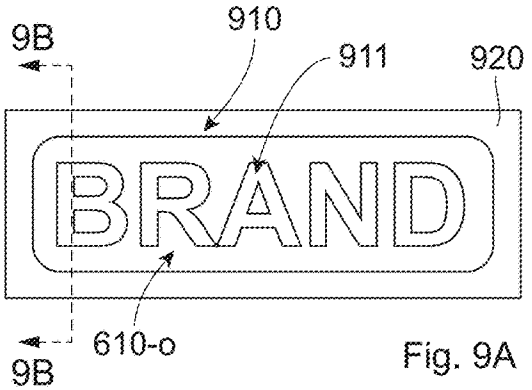
FIG. 9A illustrates a front view of branding disposed on recessed areas within raised areas.
Figure 9B:
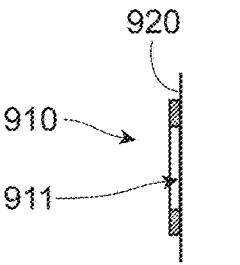
FIG. 9B illustrates a cross-section of FIG. 9A, the cross-section taken through line 9B-9B.
Figure 9C:
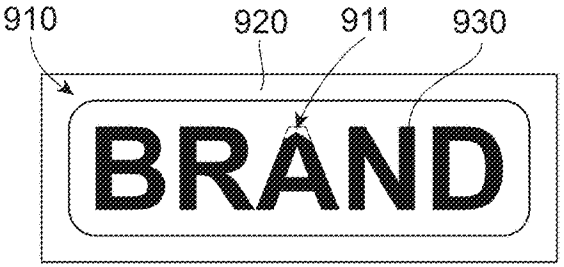
FIG. 9C illustrates a front view of branding disposed on recessed areas within raised areas.

FIG. 9A illustrates a front view of a raised area 910 wherein an overall outer shape of the raised area 910 is rectangular and an inner portion encloses a shaped recessed area 911 disposed on a portion of a package 920; FIG. 9B illustrates a cross-sectional view showing a discontinuous left-end portion of the raised area 910, wherein the recessed area 911 is relatively shorter than the raised area 910; and FIG. 9C illustrates a front view of branding 930 that is text of the word BRAND, fully disposed on the recessed area 911 within the raised area 910, wherein an overall shape of the recessed area 911 conforms to an overall outer shape of the branding 930, and an overall outer shape of the raised area 910 is not related to an overall shape of the branding 930 (shown as partially broken). In any of the embodiments disclosed herein, any graphic, can be partially or fully disposed on one or more relatively shorter recessed portions within one or more raised areas, the recessed portion(s) having an overall shape that conforms to an overall shape of the graphic, as described and illustrated in FIGS. 7A-7C.

In various alternatives to the embodiments of FIGS. 7A-10C, part, parts, or all of the recessed areas can be one or more portions of the package (without a raised area) and/or one or more portions of relatively shorter raised areas.

For any embodiment described herein, any number of any of the embodiments of FIGS. 1A-9C can be disposed together in any combination on one or more portions/panels of a package or may be disposed separately on one or more packages in a particular line-up of packages.

Figure 10A:
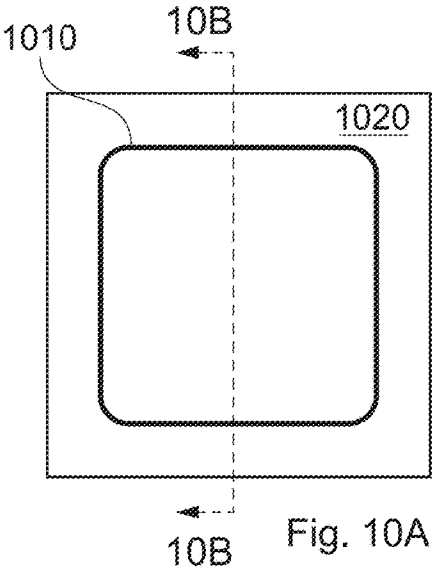
FIG. 10A illustrates graphics disposed on raised areas.
Figure 10B:
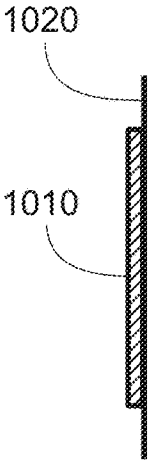
FIG. 10B illustrates a cross-section of FIG. 10A, the cross-section taken through line 10B-10B.
Figure 10C:
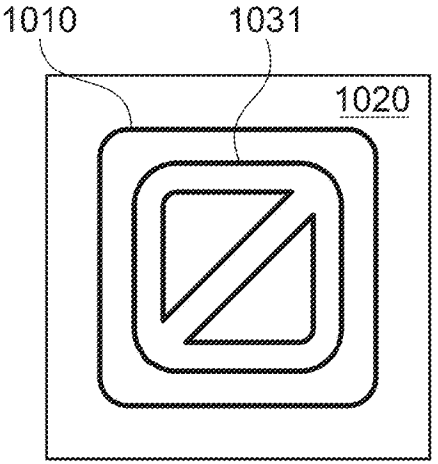
FIG. 10C illustrates graphics disposed on raised areas.

FIG. 10A illustrates a front view of a squarish raised area 1010 disposed on a portion of a package 1020; FIG. 10B illustrates a cross-sectional view (from FIG. 10A) showing a continuous center portion of the raised area 1010; and FIG. 10C illustrates a front view of a visual representation of a consumer product 1031, which is an image of a unit dose article for household cleaning (e.g. a soluble unit dose article for use in automatic washing machine), fully disposed on the raised area 1010, wherein the raised area 1010 is larger than the graphic 1031, and an overall shape of the raised area 1010 is geometrically similar to an overall outer shape of the graphic 1031. In various alternative embodiments of FIG. 10C, any form of any kind of consumer product can be visually represented in any combination with any kind of raised area, such as the combinations disclosed in the embodiments of FIGS. 1A-9C, or FIGS. 15A-16B, or FIGS. 18-19B, or FIGS. 20A-21B. In other alternative embodiments of FIG. 10C, instead of a unit dose article, any form of any kind of discrete article (i.e. an article having a form that is separate (or separable), for individual consumption and/or end-use) that is a consumer product can be visually represented in any combination with any kind of raised area, such as the combinations of graphics and raised areas disclosed in the embodiments of FIGS. 1A-9C; as examples, the discrete article can be any discrete article for any of the consumer products described herein.

Figure 11A:
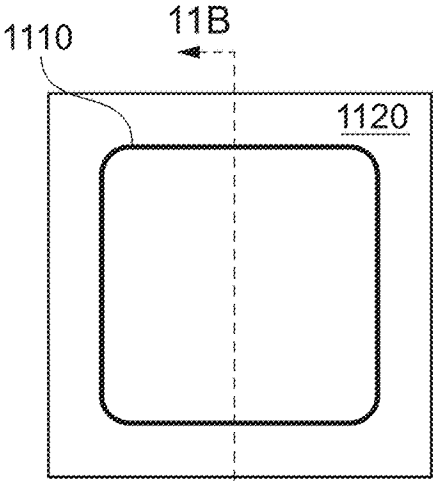
FIG. 11A illustrates graphics disposed on raised areas.
Figure 11B:
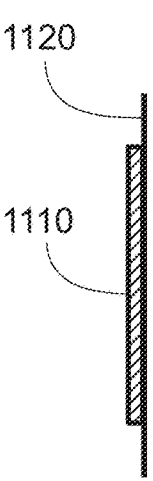
FIG. 11B illustrates a cross-section of FIG. 11A, the cross-section taken through line 11B-11B.
Figure 11C:
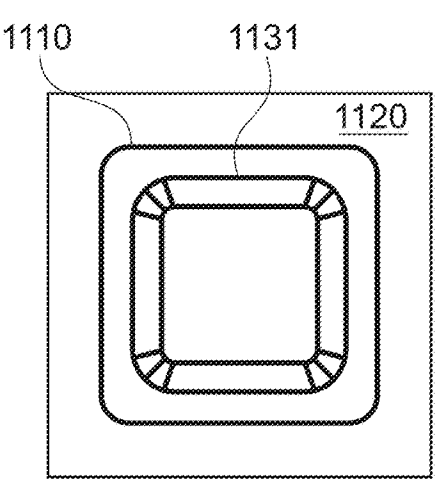
FIG. 11C illustrates graphics disposed on raised areas.

FIG. 11A illustrates a front view of a squarish raised area 1110 disposed on a portion of a package 1120; FIG. 11B illustrates a cross-sectional view (from FIG. 11A) showing a continuous center portion of the raised area 1110, and FIG. 11C illustrates a front view of a visual representation of an object intended for treatment by a consumer product 1131, which is an image of a household article to be cleaned, fully disposed on the raised area 1110, wherein the raised area 1110 is larger than the graphic 1131, and an overall shape of the raised area 1110 is geometrically similar to an overall outer shape of the graphic 1131. In various alternative embodiments of FIG. 11C, any form of any kind of object intended for treatment can be visually represented in any combination with any kind of raised area, such as the combinations of graphics and raised areas disclosed in the embodiments of FIGS. 1A-9C.

Figure 12A:
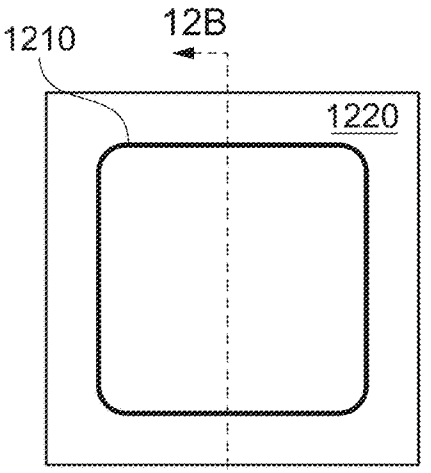
FIG. 12A illustrates graphics disposed on raised areas.
Figure 12B:
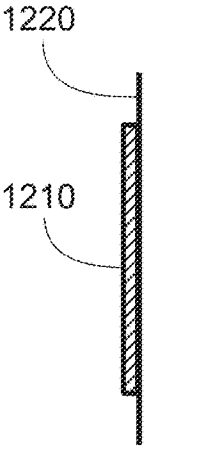
FIG. 12B illustrates a cross-section of FIG. 12A, the cross-section taken through line 12B-12B.
Figure 12C:
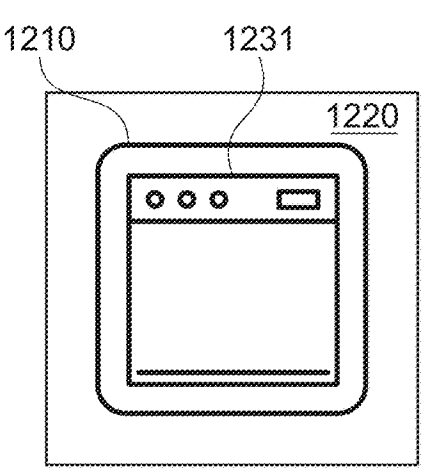
FIG. 12C illustrates graphics disposed on raised areas.

FIG. 12A illustrates a front view of a squarish raised area 1210 disposed on a portion of a package 1220; FIG. 12B illustrates a cross-sectional view (from FIG. 12A) showing a continuous center portion of the raised area 1210; and FIG. 12C illustrates a front view of a visual representation of an appliance that uses a consumer product 1231, which is an image of an automatic appliance for household washing, fully disposed on the raised area 1210, wherein the raised area 1210 is larger than the graphic 1231, and an overall shape of the raised area 1210 is geometrically similar to an overall outer shape of the graphic 1231. In various alternative embodiments of FIG. 12C, any form of any kind of appliance that uses a consumer product can be visually represented in any combination with any kind of raised area, such as the combinations of graphics and raised areas disclosed in the embodiments of FIGS. 1A-9C. In other alternative embodiments of FIG. 12C, instead of an appliance, any form of any kind of applicator or device that uses a consumer product can be visually represented in any combination with any kind of raised area, such as the combinations of graphics and raised areas disclosed in the embodiments of FIGS. 1A-9C. In still alternative embodiments of FIG. 12C, for consumer products configured for hand-use, instead of an appliance, a human hand can be visually represented in any combination with any kind of raised area, such as the combinations of graphics and raised areas disclosed in the embodiments of FIGS. 1A-9C.

Figure 13A:
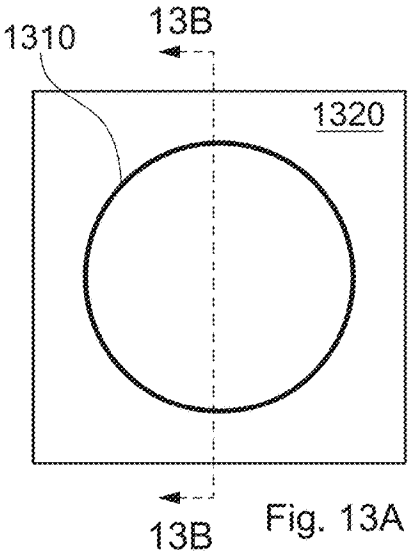
FIG. 13A illustrates graphics disposed on raised areas.
Figure 13B:
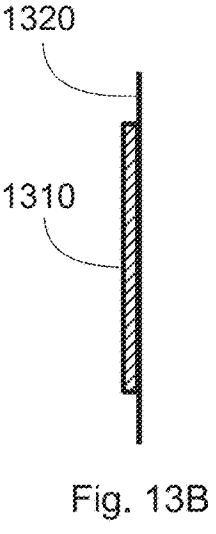
FIG. 13B illustrates a cross-section of FIG. 13A, the cross-section taken through line 13B-13B.
Figure 13C:
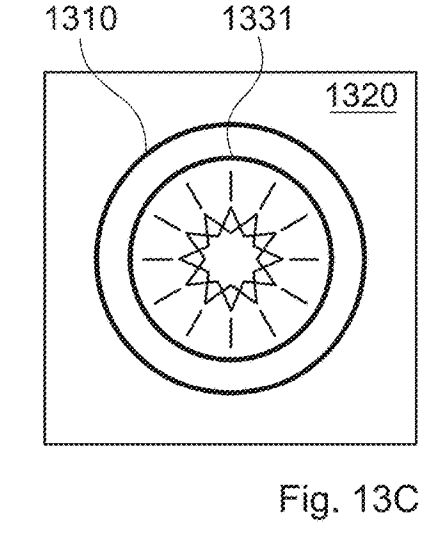
FIG. 13C illustrates graphics disposed on raised areas.

FIG. 13A illustrates a front view of a circular raised area 1310 disposed on a portion of a package 1320; FIG. 13B illustrates a cross-sectional view (from FIG. 13A) showing a continuous center portion of the raised area 1310; and FIG. 13C illustrates a front view of a visual representation of a benefit provided by a consumer product 1331, which is a graphic depicting a state of cleanliness, fully disposed on the raised area 1310, wherein the raised area 1310 is larger than the graphic 1331, and an overall shape of the raised area 1310 is geometrically similar to an overall outer shape of the graphic 1331. In various alternative embodiments of FIG. 13C, any form of any kind of benefit provided by a consumer product can be visually represented in any combination with any kind of raised area, such as the combinations of graphics and raised areas disclosed in the embodiments of FIGS. 2A-9C.

The embodiments described herein include graphics that depict particular forms of consumer products; however, these particular forms are not required; any of these graphics may depict any form of any consumer product described herein or known in the art.

Figure 14A:
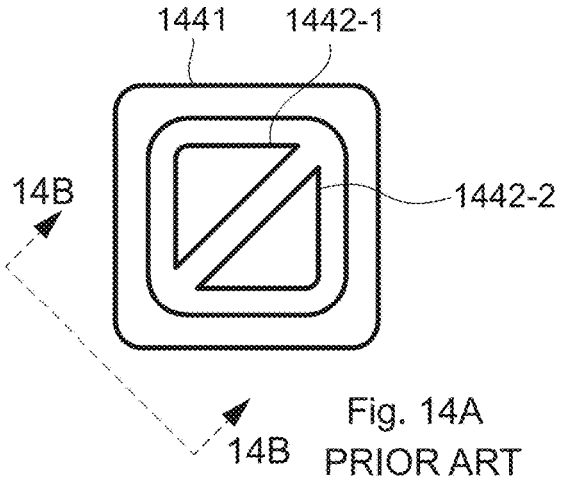
Fig. 14A PRIOR ART
FIG. 14A illustrates a prior art consumer product, which is a unit dose article.
Figure 14B:
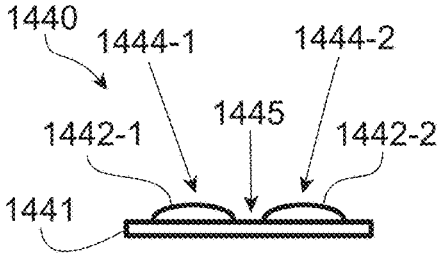
Fig. 14B PRIOR ART
FIG. 14B illustrates a cross-section of FIG. 14A, the cross-section taken through line 14B-14B.

FIG. 14A illustrates a top view of an exemplary consumer product, as known in the prior art, in the form of a unit dose article 1440 having film 1441 sealed to form a first raised triangular chamber 1442-1 and a second raised triangular chamber 1442-2 such that the article 1440 has a three-dimensional shape; and FIG. 14B illustrates an end view (from FIG. 14A) showing a first rounded protrusion 1444-1 and a second rounded protrusion 1444-2 formed, respectively, by the first chamber 1442-1 and the second chamber 1442-2 extending above the sealed film 1441, as well as a recessed portion 1445 disposed between the first protrusion 1444-1 and the second protrusion 1444-2.

Figure 15A:
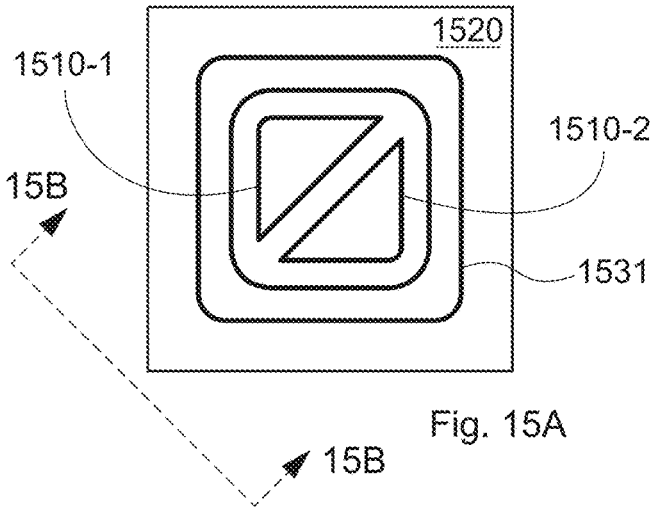
FIG. 15A illustrates graphics of a consumer product disposed on raised areas.
Figure 15B:
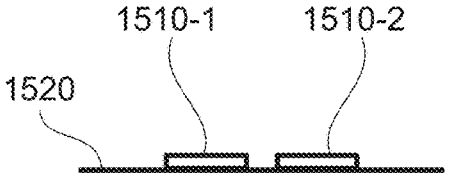
FIG. 15B illustrates a cross-section of FIG. 15A, the cross-section taken through line 15B-15B.

FIG. 15A illustrates a front view of a first triangular shaped raised area 1510-1 and a second triangular shaped raised area 1510-2 disposed on a portion of a package 1520 and a visual representation of a consumer product 1531, which is a graphic depicting the unit dose article 1440 of FIG. 14A, partially disposed on the raised areas 1510-1 and 1510-2; and FIG. 15B illustrates an end view (from FIG. 15A) showing that the overall shapes of the raised areas 1510-1 and 1510-2 conform to the overall shapes of the protrusions shown as part of the image of the consumer product 1531, such that the raised areas 1510-1 and 1510-2 approximately represent the shapes of features on the unit dose article 1440.

Figure 16A:
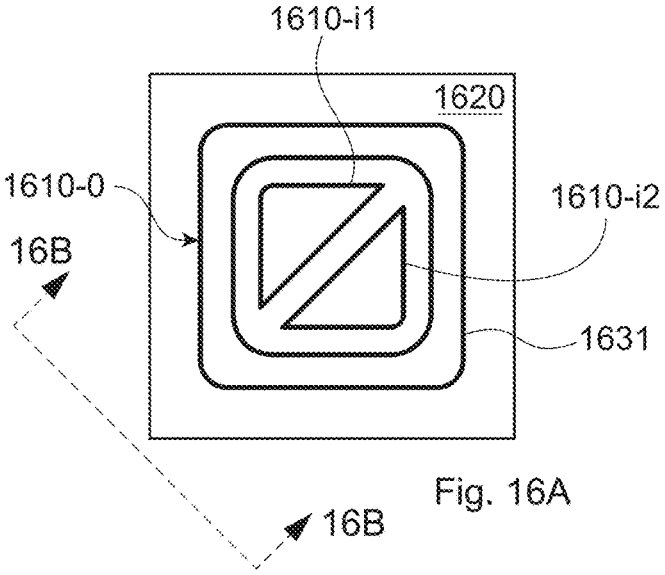
FIG. 16A illustrates graphics of a consumer product disposed on raised areas.

FIG. 16A illustrates a front view of a raised area 1610 wherein the raised area 1610 has a squarish outer portion

Figure 16B:
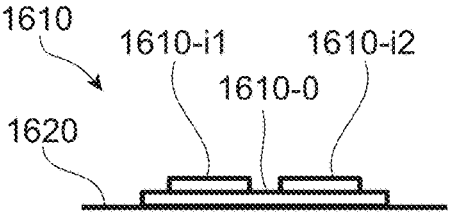
FIG. 16B illustrates a cross-section of FIG. 16A, the cross-section taken through line 16B-16B.

1610-*o* and triangular inner portions 1610-*a*1 and 1610-*a*2 and is disposed on a portion of a package 1620 and a visual representation of a consumer product 1631, which is a graphic depicting the unit dose article 1440 of FIG. 14A, fully disposed on the raised area 1610; and FIG. 16B illustrates an end view (from FIG. 16A), wherein the inner portions 1610-*a*1 and 1610-*a*2 are relatively taller and the outer portion 1610-*o* is relatively shorter, and showing that the overall shapes of the inner portions 1610-*a*1 and 1610-*a*2 conform to the overall shapes of the protrusions shown as part of the image of the consumer product 1631 and showing that the overall shape of the outer portion 1610-*o* conforms to the overall shape of the unit dose article shown in the image of the consumer product 1631, such that the raised area 1610 and its inner portions 1610-*a*1 and 1610-*a*2 approximately represent the shapes of features on the unit dose article 1440.

Figure 17A:
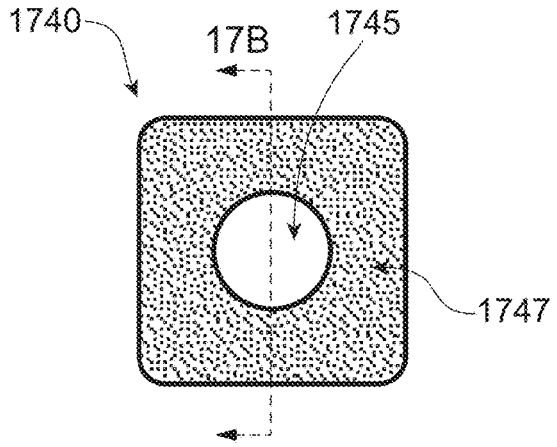
Fig. 17A PRIOR ART
FIG. 17A illustrates a prior art consumer product, which is a unit dose article.
Figure 17B:
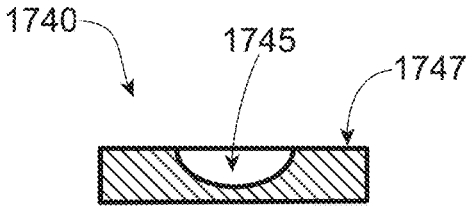
Fig. 17B PRIOR ART
FIG. 17B illustrates a cross-section of FIG. 17A, the cross-section taken through line 17B-17B.

FIG. 17A illustrates a top view of an exemplary consumer product, as known in the prior art, in the form of a unit dose article 1740 that is a tablet having an overall cuboid shape with flat sides and rounded corners, including a rough textured upper surface 1747 having a bowl-shaped recessed portion 1745 such that the article 1740 has a three-dimensional shape; and FIG. 17B illustrates a cross-sectional view (from FIG. 17A) showing a discontinuous center portion of the unit dose article 1740.

Figure 18A:
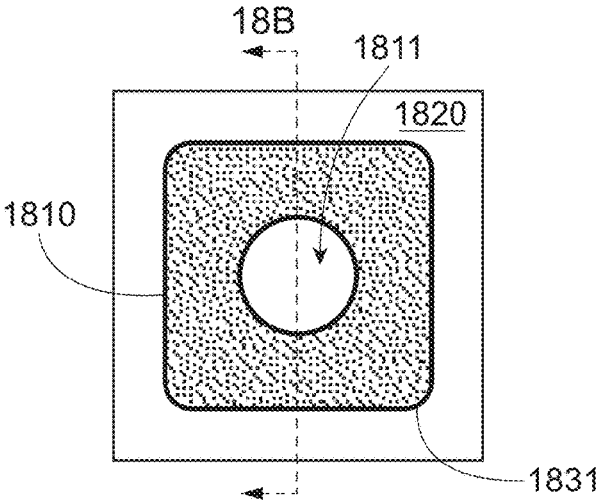
FIG. 18A_illustrates graphics of a consumer product disposed on raised areas.
Figure 18B:
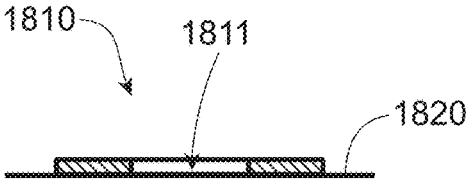
FIG. 18B illustrates a cross-section of FIG. 18A, the cross-section taken through line 18B-18B.

FIG. 18A illustrates a front view of a raised area 1810 wherein the raised area 1810 forms a squarish outline and an inner portion encloses a circular recessed area 1811 disposed on a portion of a package 1820 and a visual representation of a consumer product 1831, which is a graphic depicting the unit dose article 1740 of FIG. 17A, partially disposed on the raised area 1810; and FIG. 18B illustrates a cross-sectional view (from FIG. 18A) showing a discontinuous center portion of the raised area 1810 showing that the overall shape of the raised area 1810 conforms to the overall shape of the unit dose article shown in the image of the consumer product 1831, while the visual representation of the recessed portion of the article is disposed off of the raised area 1810, in the circular recessed area 1811, such that the raised area 1810 and the recessed area 1811 approximately represent the shapes of features on the unit dose article 1740; the rough article texture on the upper surface of the unit dose article 1740 can be depicted as part of the graphic disposed on the raised area 1810 and/or can be represented by a raised area texture added to part, parts, or all of the outer surface of the raised area 1810, such that a texture of the unit dose article 1740 is approximately represented by graphics and/or texture disposed on the raised area 1810.

Figure 19A:
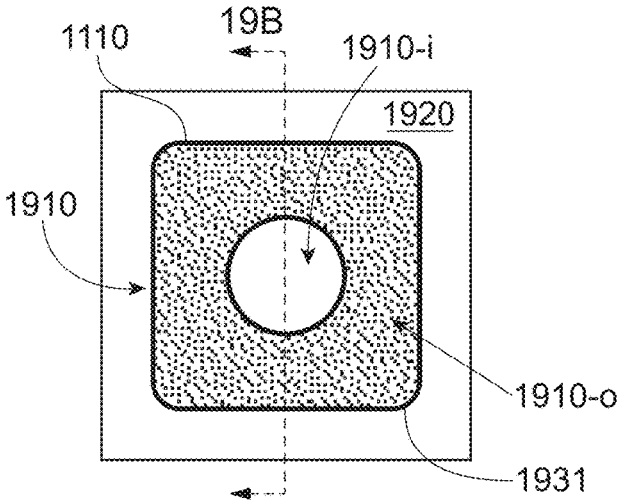
FIG. 19A illustrates graphics of a consumer product disposed on raised areas.
Figure 19B:
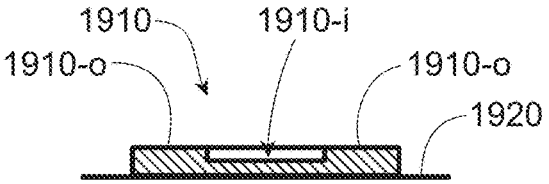
FIG. 19B illustrates a cross-section of FIG. 19A, the cross-section taken through line 19B-19B.

FIG. 19A illustrates a front view of a raised area 1910 wherein the raised area 1910 has a squarish outer portion 1910-*o* and a circular inner portion 1910-*a* disposed on a portion of a package 1920 and a visual representation of a consumer product 1931, which is a graphic depicting the unit dose article 1740 of FIG. 17A, fully disposed on the raised area 1910; and FIG. 19B illustrates a cross-sectional view (from FIG. 19A) showing a discontinuous center portion of the raised area 1910, wherein the inner portion 1910-*a* is relatively shorter and the outer portion 1910-*o* is relatively taller, and showing that the overall shape of the raised area 1910 conforms to the overall shape of the unit dose article shown in the image of the consumer product 1931, while the visual representation of the recessed portion of the article is disposed on the shaped inner portion 1910-*a*, such that the raised area 1910 with its inner portion 19104 and outer portion 1910-*o* approximately represents the shapes of features on the unit dose article 1740; the rough article texture on the upper surface of the unit dose article 1740 can be depicted as part of the graphic disposed on the raised area 1910 and/or can be represented by a raised area texture added to part, parts, or all of the outer surface of the raised area 1910, such that a texture of the unit dose article 1740 is approximately represented by graphics and/or texture disposed on the raised area 1910.

In various embodiments, any form of any kind of consumer product can be visually represented in any combination with one or more of any kind of raised area, according to any embodiment described herein; and any or all of the one or more raised areas can approximately represent part, parts, or all of one or more of any of the shapes of features on the consumer product. In various embodiments, any form of any kind of texture (e.g. rough, smooth, patterned, etc.), and/or finish (e.g. glossy, matte, etc.), and or surface condition (e.g. soft, sticky, slick, etc.) on a consumer product can be represented by graphics and/or texture disposed on a raised area.

Figure 20A:
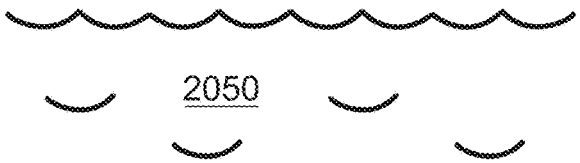
Fig. 20A PRIOR ART
FIG. 20A_illustrates prior art graphics.
Figure 20B:
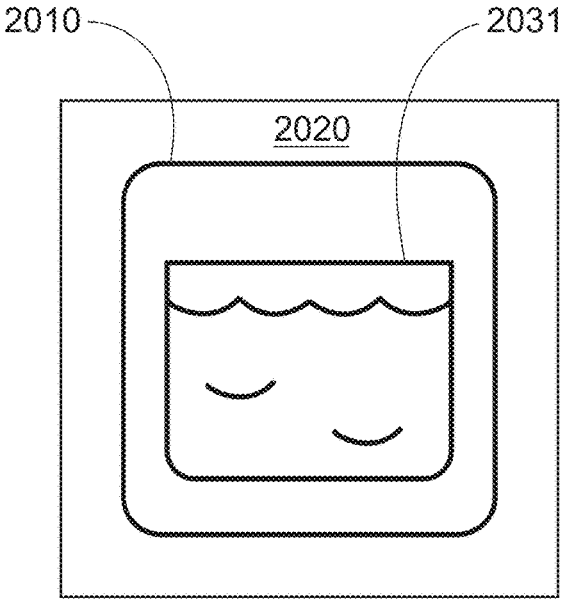
FIG. 20B illustrates a front view of a squarish raised area disposed on a portion of a package.

FIG. 20A illustrates a side view of a quantity of consumer product 2050 in a dosable liquid form as known in the prior art; and FIG. 20B illustrates a front view of a squarish raised area 2010 disposed on a portion of a package 2020, and a visual representation of a consumer product 2031, which is a graphic depicting a transparent container holding a quantity of the consumer product 2050 of FIG. 20A, fully disposed on the raised area 2010, wherein the raised area 2010 is larger than the graphic 2031, and an overall shape of the raised area 2010 is geometrically similar to an overall outer shape of the container depicted in the graphic 2031, but not related to any particular shape of the dosable liquid form of the consumer product 2050.

Figure 21A:
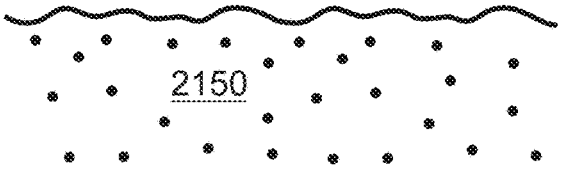
Fig. 21A PRIOR ART
FIG. 21A illustrates prior art graphics.
Figure 21B:
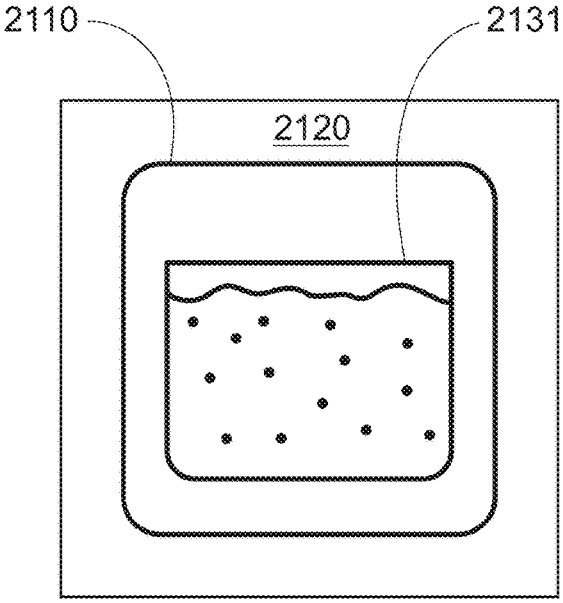
FIG. 21B illustrates a front view of a squarish raised area disposed on a portion of a package.

FIG. 21A illustrates a side view of a quantity of consumer product 2150 in a dosable dry form, as known in the prior art; and FIG. 21B illustrates a front view of a squarish raised area 2110 disposed on a portion of a package 2120, and a visual representation of a consumer product 2131, which is a graphic depicting a transparent container holding a quantity of the consumer product 2150 of FIG. 21A, fully disposed on the raised area 2110, wherein the raised area 2110 is larger than the graphic 2131, and an overall shape of the raised area 2110 is geometrically similar to an overall outer shape of the container depicted in the graphic 2131, but not related to any particular shape of the dosable dry form of the consumer product 2150.

For any embodiment described herein, any number of any of the embodiments of FIGS. 10A-13C, 15A-16B, 18A-19B, and 20A-21B can be disposed together in any combination on one or more portions/panels of a package or may be disposed separately on one or more packages in a line-up of packages.

In various embodiments, when two or more of the embodiments of FIGS. 10A-13C, 15A-16B, 18A-19B, and/or 20A-21B are disposed together in combination, the graphics of those embodiments may be related by a particular consumer product; as a first example, an image of a consumer product and an image of an object for treatment by that particular consumer product may be disposed together on one or more raised areas of a package; as a second example, an image of a consumer product and an image of an appliance that uses that particular consumer product may be disposed together on one or more raised areas of a package; as a third example, an image of a consumer product and an image of a benefit provided by that particular consumer product may be disposed together on one or more raised areas of a package; as a fourth example, an image of an object for treatment by a particular consumer product and/or an image of an appliance that uses that particular consumer product and/or an image of a benefit provided by that particular consumer product may be disposed together, in any combination, on one or more raised areas of a package.

For any embodiment described herein, any number of any of the embodiments of FIGS. 1A-9C and any number of any of the embodiments of FIGS. 10A-13C, 15A-16B, 18A-19B, and/or 20A-21B can be disposed together in any combination on one or more portions/panels of a package. In various embodiments, when any of the embodiments of FIGS. 1A-9C are disposed together on a package with any of any of the embodiments of FIGS. 10A-13C, 15A-16B, 18A-19B, and/or 20A-21B, one or more brandings from FIGS. 1A-9C that are related to a particular consumer product may also be related to one or more graphics from FIGS. 10A-13C, 15A-16B, 18A-19B, and/or 20A-21B.

For any embodiment in which multiple raised areas are disposed together on a panel of a package or on a package, some or all of the raised areas may be in contact with each other, and/or immediately adjacent to each other, and/or separated from each another by an offset distance, in any convenient way.

Figure 2C:
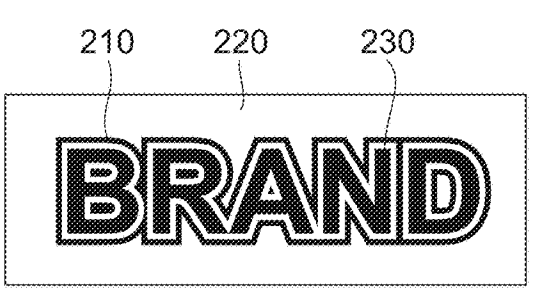
FIG. 2C illustrates a front view of branding disposed on raised areas.
Figure 22B:
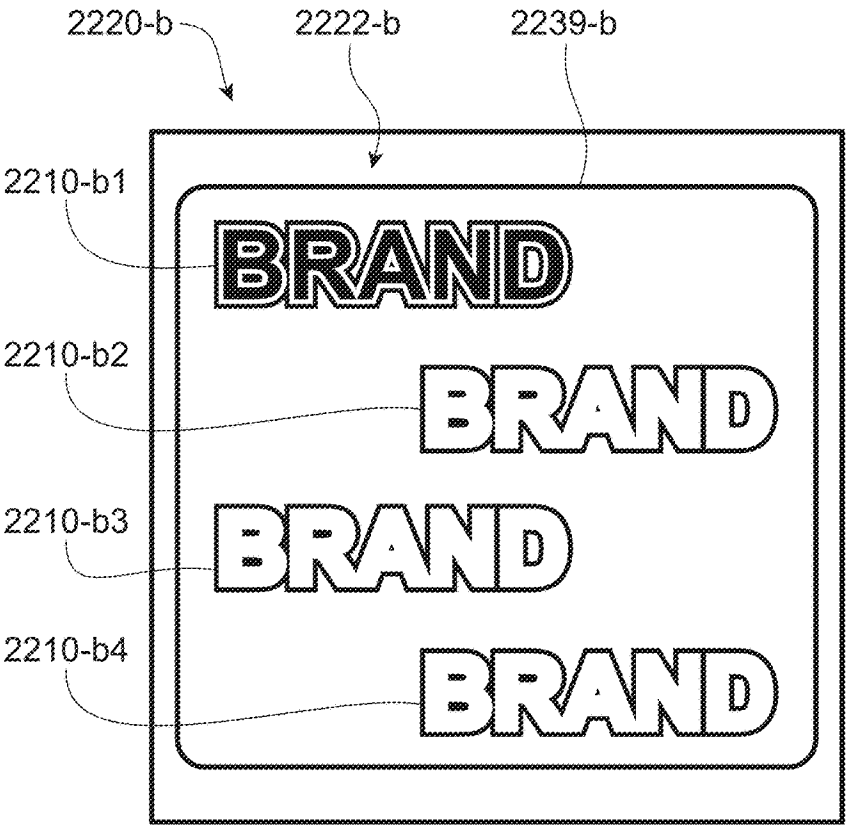
FIG. 22B illustrates a package with graphics disposed on raised areas.
Figure 22A:
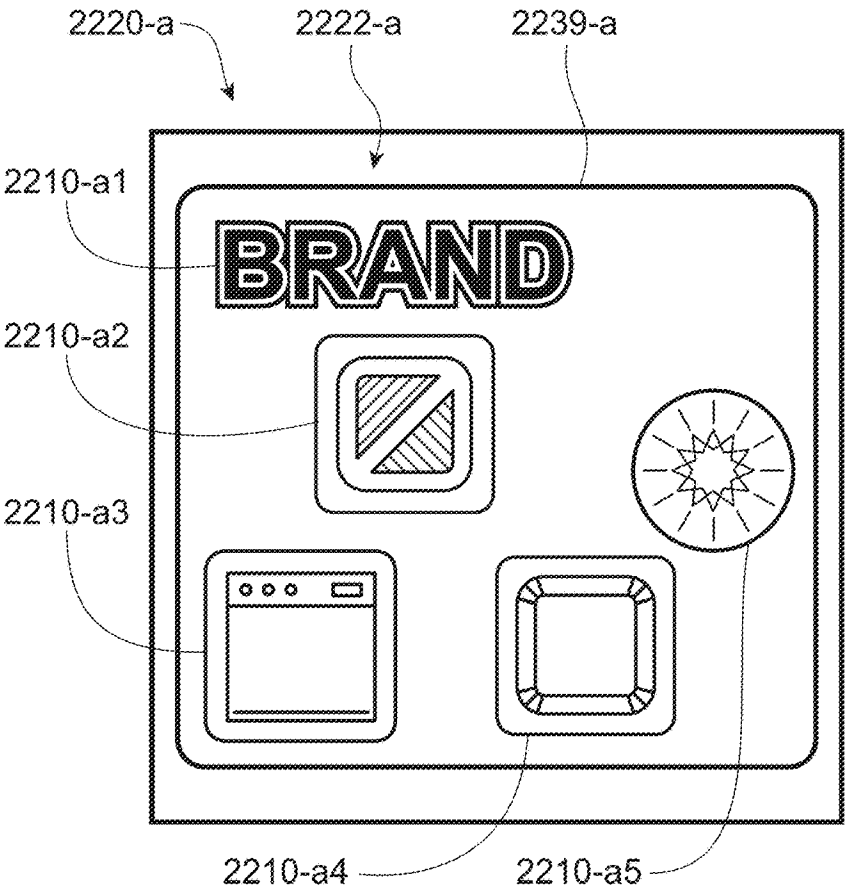
FIG. 22A illustrates a package with graphics disposed on raised areas.

FIG. 22A illustrates a portion 2220-*a* of an exemplary package for retail sale of a consumer product, wherein the portion is a panel 2222-*a* of flexible material, having: external artwork 2239-*a* that includes a number of visual representations (described below), a first raised area 2210-*a*1 with branding for the consumer product (as described and illustrated with respect to the embodiment of FIG. 2C); a second raised area 2210-*a*2 with an image of the consumer product (as described and illustrated with respect to the embodiment of FIG. 16B); a third raised area 2210-*a*3 with an image of an appliance that uses the consumer product (as described and illustrated with respect to the embodiment of FIG. 12C); a fourth raised area 2210-*a*4 with an image of an object intended for treatment by the consumer product (as described and illustrated with respect to the embodiment of FIG. 11C); and a fifth raised area 2210-*a*5 with an image of a benefit provided by the consumer product (as described and illustrated with respect to the embodiment of FIG. 13C). In the embodiment of FIG. 22A, one or more of any of the raised areas and/or one or more of any of the graphics may be omitted, in any combination.

FIG. 22B illustrates a portion 2220-*b* of a package for retail sale of a consumer product, wherein the portion is a panel 2222-*b* of flexible material, having: external artwork 2239-*b* that includes a number of visual representations (described below), a first raised area 2210-*b*1 with branding for the consumer product (as described and illustrated with respect to the embodiment of FIG. 2C); a second raised area 2210-*b*2, which is configured in the same way as the first raised area 2210-*b* 1, but without branding; a third raised area 2210-*b*3 configured in the same way as the second raised area 2210-*b*2; and a fourth raised area 2210-*b*4 configured in the same way as the second raised area 2210-*b*2. In the embodiment of FIG. 22B, one or more of any of the raised areas and/or one or more of any of the graphics may be omitted, in any combination. In various alternative embodiments of FIG. 22B, external artwork and/or graphics that are unrelated to the unbranded raised area(s), may be printed over one or more of those raised areas.

In any of the embodiments disclosed herein, a reinforcing area can have an overall height within the range of 40-5000 microns, or any integer value for microns from 40-5000, or any range formed by any of these values. As examples, a raised area may have an overall height of 40-2520 microns, 40-1528 microns, 40-1032 microns, 40-536 microns, 40-288 microns, 40-164 microns, 40-90 microns, 40-65 microns, 65-2520 microns, 90-1528 microns, 164-1032 microns, 288-536 microns, 65-5000 microns, 90-5000 microns, 164-5000 microns, 288-5000 microns, 536-5000 microns, 1032-5000 microns, 1528-5000 microns, 2520-5000 microns, etc. In any of the embodiments disclosed herein, wherein one portion of a raised area is relatively taller than a relatively shorter portion of a raised area, the taller portion may be 1-1,000% taller than the relatively shorter portion, or any integer value for percentage from 1-1000, or any range formed by any of these values. As examples, a relatively taller raised area may have an overall height that is 1-501% taller, 1-301% taller, 1-201% taller, 1-101% taller, 1-51% taller, 1-26% taller, 1-11% taller, 1-6% taller, 6-501% taller, 11-301% taller, 26-201% taller, 51-101% taller, 6-1,000% taller, 11-1,000% taller, 26-1,000% taller, 51-1,000% taller, 101-1,000% taller, 201-1,000% taller, 301-1,000% taller, 501-1,000% taller, etc. A reinforcing area can have any suitable length and width.

FIGS. 23A-26C describe various embodiments of raised reinforcing lines that may be disposed on any portion of any kind of package disclosed herein or known in the art. For any embodiment described herein, each plurality of raised reinforcing lines disposed on the package has an overall reinforcing pattern, wherein part, parts, or all of the overall reinforcing pattern may be repeated in a same or similar form on one or more other portions and/or other panels of the package. While particular patterns are shown in FIGS. 23A-26C, any suitable pattern can be used.

Figure 23B:
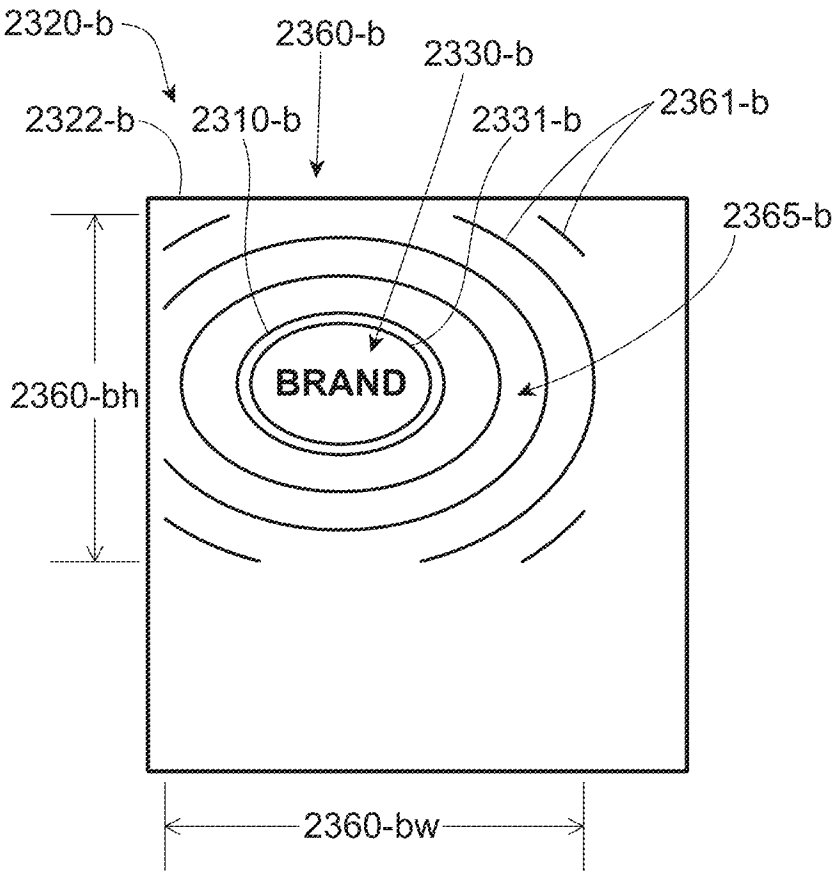
FIG. 23B illustrates a package with graphics disposed on raised areas.
Figure 23A:
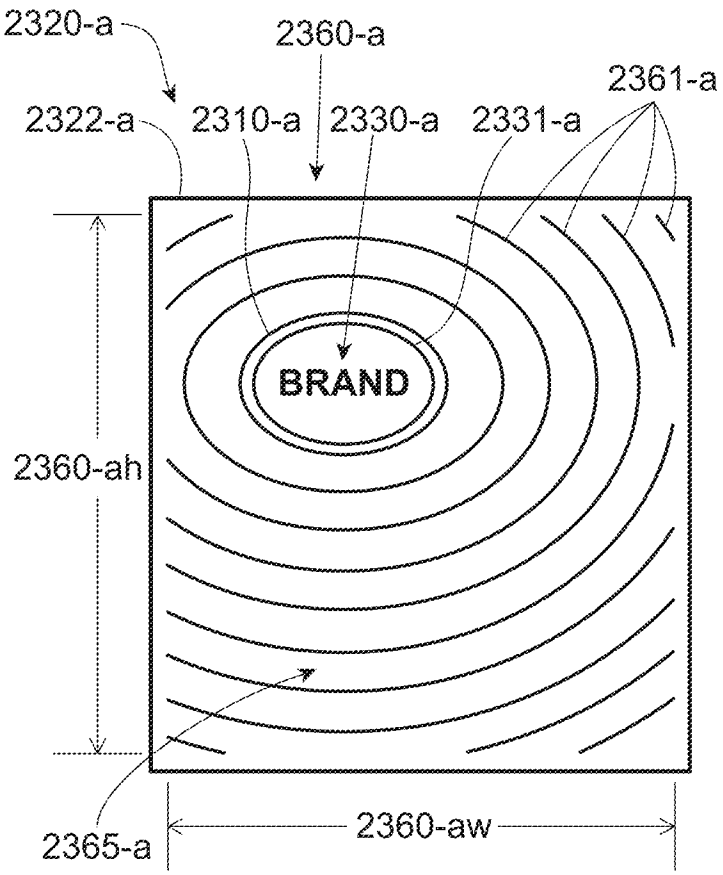
FIG. 23A_illustrates a package with raised areas and raised reinforcing lines.

FIG. 23A illustrates a portion 2320-*a* of a package for retail sale of a consumer product, wherein the portion is a panel 2322-*a* of flexible material, having: external artwork that includes a number of visual representations (described below), an elliptical raised area 2310-*a*1 with branding 2330-*a* (as described and illustrated with respect to the embodiment of FIG. 1C) for the consumer product and an elliptical graphic 2331-*a* (that may be any graphic) used in conjunction with the branding 2330-*a*, wherein the branding 2330-*a* and the graphic 2331-*a* are fully disposed on the raised area 2310-*a*1, wherein the raised area 2310-1*a* is larger than the branding 2330 and the graphic 2331-*a*, and wherein an overall outer shape of the raised area 2310 is geometrically similar to an overall outer shape of the graphic 2331-*a*, the panel 2322-*a* further having a plurality 2360-*a* of raised reinforcing lines 2361-*a* (labeled in part), which includes all of the elliptical-shaped reinforcing lines (and line-segments) that together concentrically surround the raised area 2310-*a*, wherein overall shapes of the raised reinforcing lines 2361-*a* are geometrically similar to the overall shape of the raised area 2310-*a* and to each other, and the plurality 2360-*a* of the raised reinforcing lines 2361-*a* extends over a reinforcing area 2365-*a* having an overall height 2360-*ah* and an overall width 2360-*aw* within the total area of the panel 2322-*a*. In various alternative embodiments, some or all of raised reinforcing lines can have any shape (e.g. any closed geometry), which may be the same as, similar to, or different from the shape of any other raised reinforcing lines in the plurality; such shapes may or may not be nested inside each other, and may or may not be centered on a common point.

FIG. 23B illustrates a portion 2320-*b* of a package for retail sale of a consumer product, wherein the embodiment of FIG. 23B is similar to the embodiment of FIG. 23A with like-numbered elements configured in the same way, except that the raised reinforcing lines 2361-*b* are fewer in number than the raised reinforcing lines 2361-*a* of FIG. 23A, the overall height 2360-*bh* is smaller than the overall height 2360-*ah* of FIG. 23A, and the overall width 2360-*bw* is smaller than the overall width 2360-*aw* of FIG. 23A, resulting in a reinforcing area 2365-*b*, which is significantly smaller than the reinforcing area 2365-*a* of FIG. 23A.

Figure 24C:
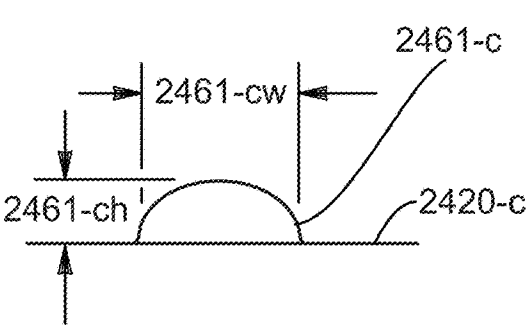
FIG. 24C illustrate a profile of raised reinforcing lines.
Figure 24B:
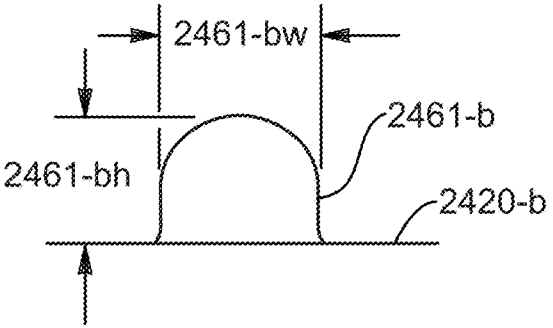
FIG. 24B illustrate a profile of raised reinforcing lines.
Figure 24A:
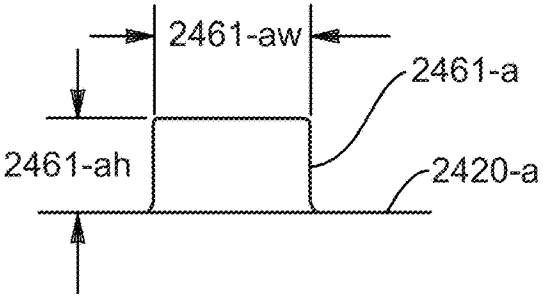
FIG. 24A illustrate a profile of raised reinforcing lines.

FIG. 24A illustrates an end profile view, which shows a rectangular profile for a raised reinforcing line 2461-*a* disposed on a portion 2420-*a* of a package, wherein the raised reinforcing line 2461-*a* is a structure having: an overall height 2461-*ah* measured at a particular location along the raised reinforcing line 2461-*a*, measured linearly and perpendicular to the portion 2420-*a* of the package, from an outer surface of the portion 2420-*a* to a point on the profile of the raised reinforcing line 2461-*a* that is farthest away from the outer surface (the overall heights of all raised areas and raised reinforcing lines are measured in this way); and an overall width 2461-*aw* measured at a particular location along the raised reinforcing line 2461-*a*, measured linearly, parallel to an outer surface of the portion 2420-*a* of the package and perpendicular to the pathway of the raised reinforcing line 2461-*a*, between the two points on the profile of the raised reinforcing line 2461-*a* that are farthest apart from each other (the overall widths of all raised reinforcing lines are measured in this way). For measurements of overall height and overall width made on a portion of a package that is a flexible material, the flexible material is held flat.

FIG. 24B illustrates an end profile view, which shows a semi-circular profile for a raised reinforcing line 2461-*b* disposed on a portion 2420-*b* of a package, wherein the overall height and overall width dimensions of the raised reinforcing line 2461-*b* are measured in the same way as like-numbered dimensions of FIG. 23A.

FIG. 24C illustrates an end profile view, which shows an semi-elliptical profile for a raised reinforcing line 2461-*c* disposed on a portion 2420-*c* of a package, wherein the overall height and overall width dimensions of the raised reinforcing line 2461-*c* are measured in the same way as like-numbered dimensions of FIG. 23A.

In any of the embodiments disclosed herein, a plurality of raised reinforcing lines can have an overall height within the range of 40-5000 microns, or any integer value for microns from 40-5000, or any range formed by any of these values. As examples, a raised area may have an overall height of 40-2520 microns, 40-1528 microns, 40-1032 microns, 40-536 microns, 40-288 microns, 40-164 microns, 40-90 microns, 40-65 microns, 65-2520 microns, 90-1528 microns, 164-1032 microns, 288-536 microns, 65-5000 microns, 90-5000 microns, 164-5000 microns, 288-5000 microns, 536-5000 microns, 1032-5000 microns, 1528-5000 microns, 2520-5000 microns, etc.

In any of the embodiments disclosed herein, part, parts, or all of a raised area and/or a raised reinforcing line can have an overall height that is about uniform, or approximately uniform, or substantially uniform, nearly uniform, or completely uniform across its area or along its length; and/or part, parts, or all of a raised area and/or a raised reinforcing line can have an overall height that is non-uniform across its area or along its length. In any of the embodiments disclosed herein, some or all of the raised reinforcing lines in a plurality of raised reinforcing lines can have overall heights that are about the same, or approximately the same, or substantially the same, nearly the same, or completely the same; and/or some or all of the raised reinforcing lines in a plurality of raised reinforcing lines can have overall heights that differ. In any of the embodiments disclosed herein, having one or more raised areas as well as one or more raised reinforcing lines, one, or some, or all of the raised areas can have an overall height that is about the same, or approximately the same, or substantially the same, nearly the same, or completely the same as one, or some, or all of the raised reinforcing lines.

In any of the embodiments disclosed herein, a plurality of raised reinforcing lines can have an overall width within the range of 25-25,000 microns, or any integer value for microns from 25-25,000, or any range formed by any of these values. As examples, a raised reinforcing line may have an overall height of 25-12,513 microns, 25-6,269 microns, 25-2,523 microns, 25-1,274 microns, 6,269-12,513 microns, 1,274-2,523 microns, 1,274-25,000 microns, 2,523-25,000 microns, 6,269-25,000 microns, 12,513-25,000 microns, etc.

In any of the embodiments disclosed herein, part, parts, or all of a raised reinforcing line can have an overall width that is about uniform, or approximately uniform, or substantially uniform, nearly uniform, or completely uniform along its length; and/or part, parts, or all of a raised reinforcing line can have an overall width that is non-uniform along its length. In any of the embodiments disclosed herein, some or all of the raised reinforcing lines in a plurality of raised reinforcing lines can have overall widths that are about the same, or approximately the same, or substantially the same, nearly the same, or completely the same; and/or some or all of the raised reinforcing lines in a plurality of raised reinforcing lines can have overall widths that differ.

Figure 25B:
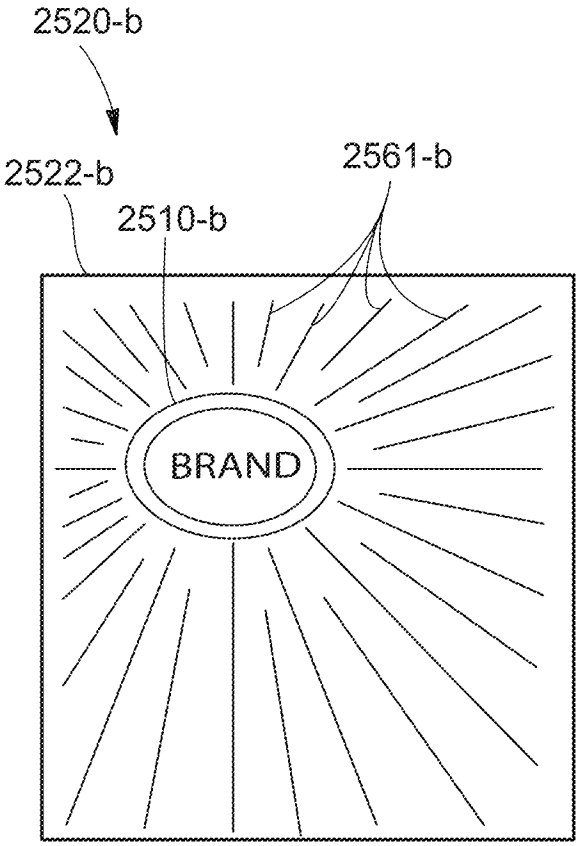
FIG. 25B illustrates a package with alternative embodiments of raised reinforcing lines.
Figure 25A:
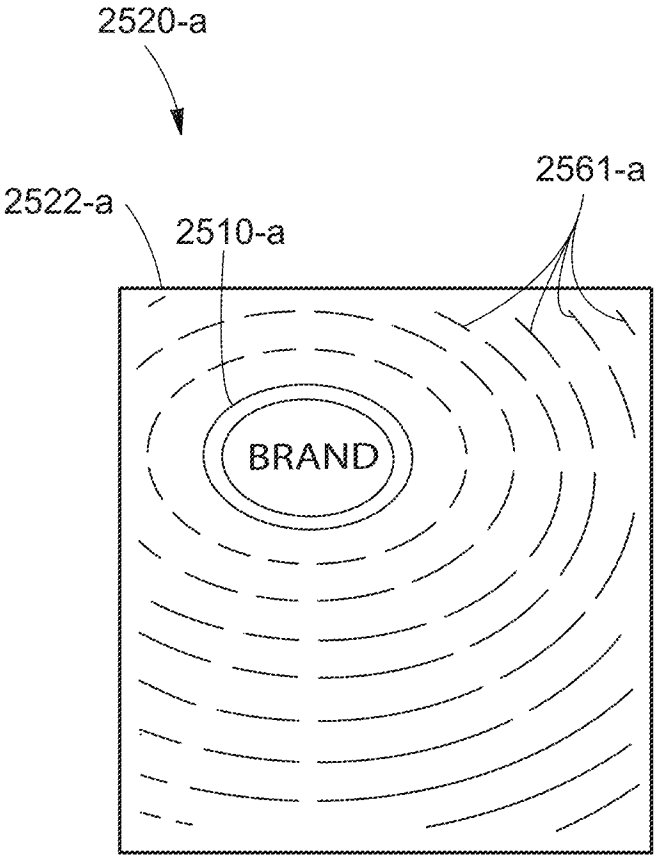
FIG. 25A_illustrates a package with alternative embodiments of raised reinforcing lines.

FIG. 25A illustrates a front view of a portion 2520-*a* of a package for retail sale of a consumer product, wherein the embodiment of FIG. 25A is similar to the embodiment of FIG. 23A with like-numbered elements configured in the same way, except that the raised reinforcing lines 2561-*a* are broken at regular intervals along their pathways. In any of the embodiments disclosed herein, any raised reinforcing lines can be broken in any suitable manner described herein or known in the art.

FIG. 25B illustrates a front view of a portion 2520-*a* of a package for retail sale of a consumer product, wherein the embodiment of FIG. 25B is similar to the embodiment of FIG. 23A with like-numbered elements configured in the same way, except that the raised reinforcing lines 2561-*b* are linear segments arranged in a radial array that is centered on a center of the raised area 2510-*b*. In any of the embodiments disclosed herein, raised reinforcing lines can be arranged in any kind of radial array, which may or may not be centered on a raised area, on a graphic, or on branding.

Figure 25D:
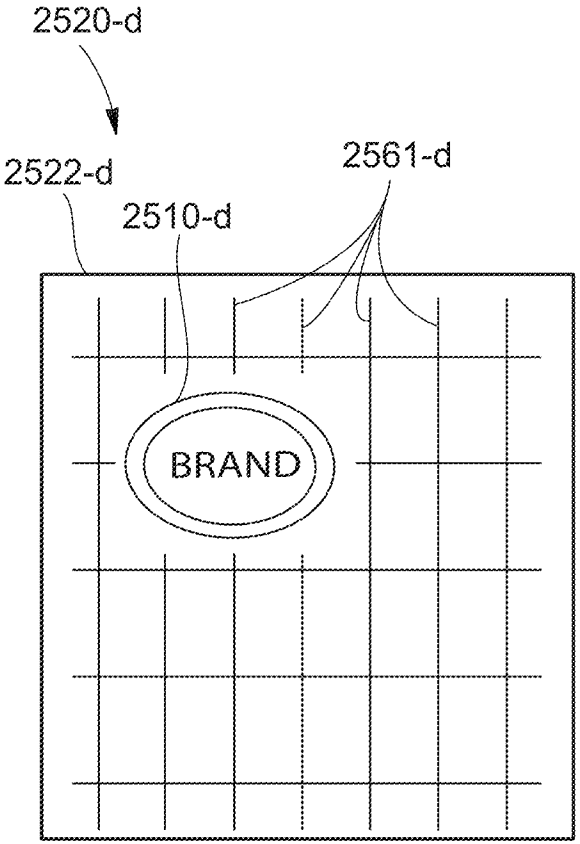
FIG. 25D illustrates a package with alternative embodiments of raised reinforcing lines.
Figure 25C:
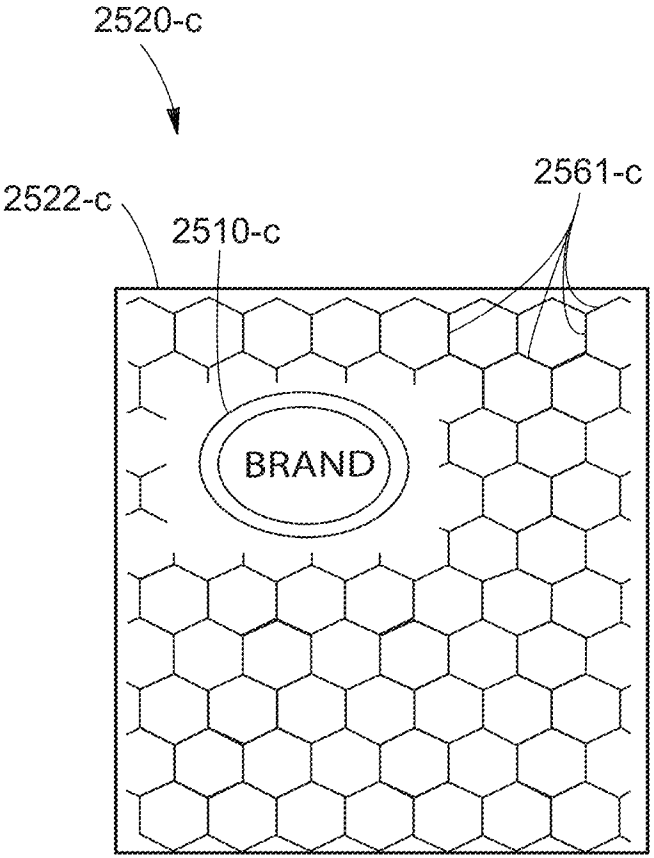
FIG. 25C illustrates a package with alternative embodiments of raised reinforcing lines.

FIG. 25C illustrates a front view of a portion 2520-*c* of a package for retail sale of a consumer product, wherein the embodiment of FIG. 25C is similar to the embodiment of FIG. 23A with like-numbered elements configured in the same way, except that the raised reinforcing lines 2561-*c* are linear segments arranged in a connected, tessellating, hexagonal pattern that is partially interrupted by the raised area 2510-*c*. In any of the embodiments disclosed herein, raised reinforcing lines can be arranged in any kind of connected pattern.

FIG. 25D illustrates a front view of a portion 2520-*d* of a package for retail sale of a consumer product, wherein the embodiment of FIG. 25D is similar to the embodiment of FIG. 23A with like-numbered elements configured in the same way, except that the raised reinforcing lines 2561-*d* are linear segments arranged in an orthogonally arrayed crossing pattern that is partially interrupted by the raised area

2510-*d*. In any of the embodiments disclosed herein, raised reinforcing lines can be arranged in any kind of orthogonal array.

Figure 25F:
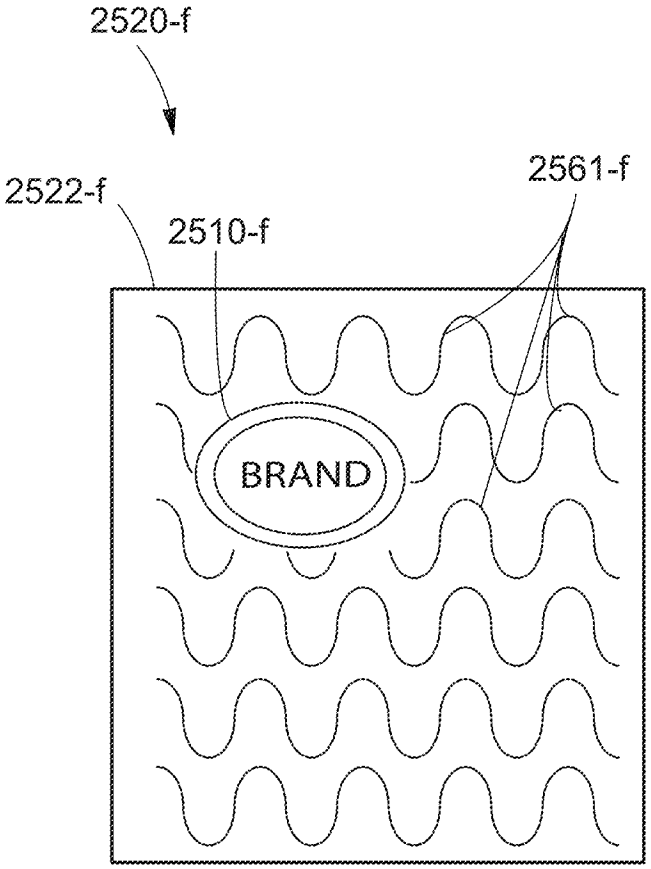
FIG. 25F illustrates a package with alternative embodiments of raised reinforcing lines.
Figure 25E:
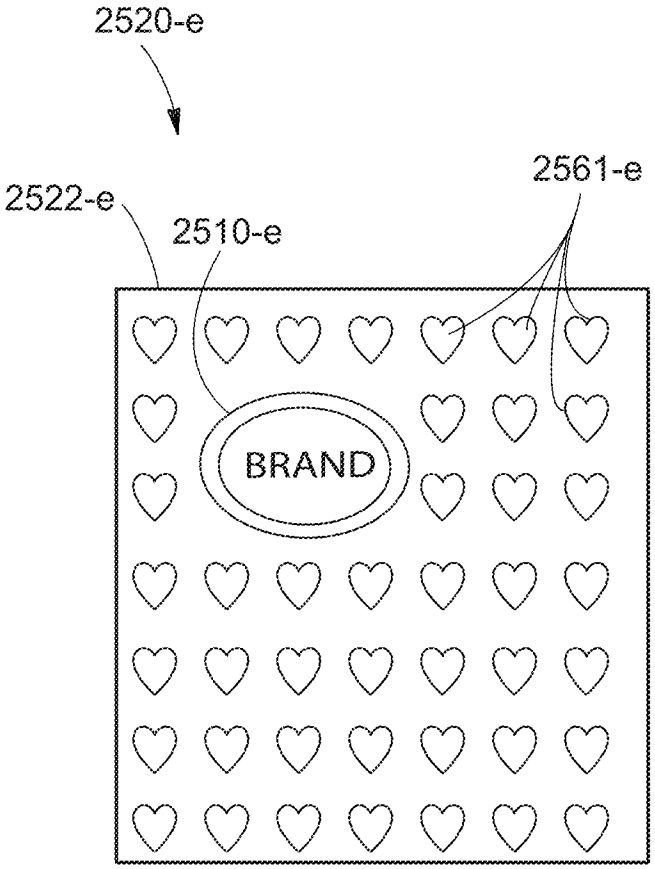
FIG. 25E illustrates a package with alternative embodiments of raised reinforcing lines.

FIG. 25E illustrates a front view of a portion 2520-*e* of a package for retail sale of a consumer product, wherein the embodiment of FIG. 25E is similar to the embodiment of FIG. 23A with like-numbered elements configured in the same way, except that the raised reinforcing lines 2561-*e* are closed geometric shapes (i.e. hearts) arranged in a orthogonally arrayed pattern of rows and columns that is partially interrupted by the raised area 2510-*e*. In any of the embodiments disclosed herein, raised reinforcing lines can be formed into any number of any kind of shape, which can be arranged in any manner.

FIG. 25F illustrates a front view of a portion 2520-*f* of a package for retail sale of a consumer product, wherein the embodiment of FIG. 25F is similar to the embodiment of FIG. 23A with like-numbered elements configured in the same way, except that the raised reinforcing lines 2561-*f* are repeating waves, arranged in an array of rows that is partially interrupted by the raised area 2510-*f*. In any of the embodiments disclosed herein, raised reinforcing lines can be formed into any kind of repeating pattern, which can be arranged in any manner.

Figure 26A:
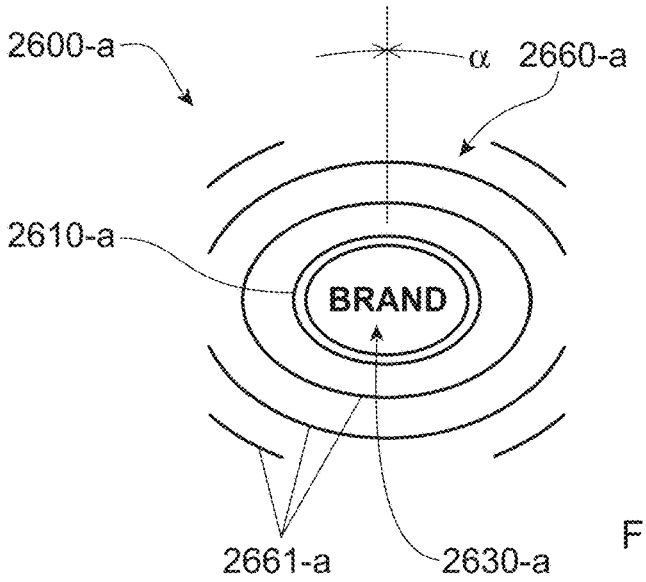
FIG. 26A illustrates a raised reinforcing line surrounding raised areas in various degrees.

FIG. 26A illustrates a front view of a portion 2600-*a* of the panel 2322-*a* of FIG. 23A, including a raised area 2610-*a* with branding 2630-*a*, and part of a plurality 2660-*a* of raised reinforcing lines 2661-*a*, all of which are configured in the same way as like-numbered elements in the embodiment of FIG. 23A, and showing that the reinforcing lines 2661-*a* surround an outer perimeter of the branding 2630-*a* by an angle α (centered on the center of the branding 2630-*a*), which is 360°, such that the reinforcing lines surround 100% of the outer perimeter.

Figure 26B:
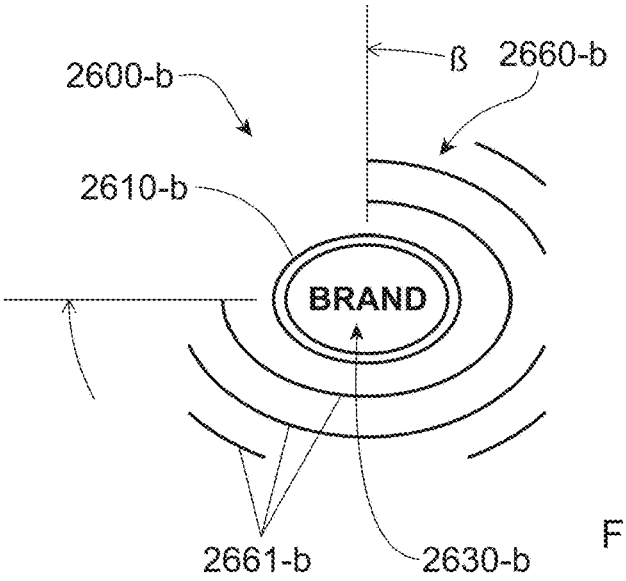
FIG. 26B illustrates a raised reinforcing line surrounding raised areas in various degrees.

FIG. 26B illustrates a front view of a portion 2600-*b* of a panel, which is a modified version of the portion 2600-*a* of FIG. 26A, in which all of the elements of FIG. 26B are the same as like-numbered elements in the embodiment of FIG. 26A, except that the reinforcing lines 2661-*b* surround an outer perimeter of the branding 2630-*b* by an angle β (centered on the center of the branding 2630-*b*), which is 270°, such that the reinforcing lines surround 75% of the outer perimeter.

Figure 26C:
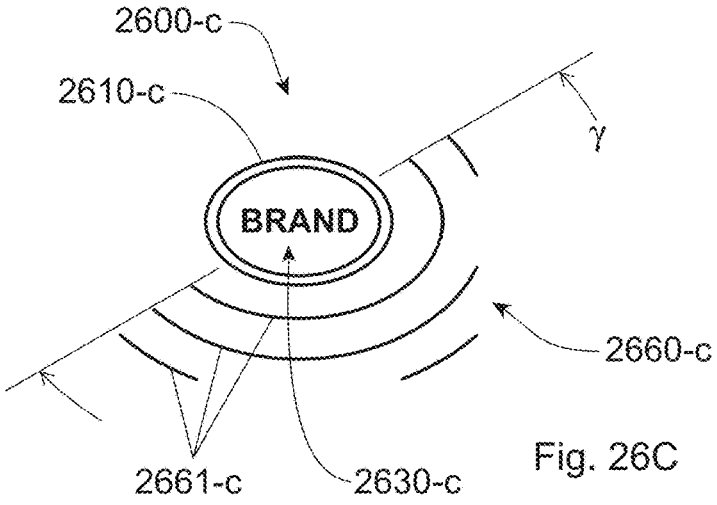
FIG. 26C illustrates a raised reinforcing line surrounding raised areas in various degrees.

FIG. 26C illustrates a front view of a portion 2600-*c* of a panel, which is a modified version of the portion 2600-*a* of FIG. 26A, in which all of the elements of FIG. 26C are the same as like-numbered elements in the embodiment of FIG. 26A, except that the reinforcing lines 2661-*c* surround an outer perimeter of the branding 2630-*c* by an angle γ (centered on the center of the branding 2630-*c*), which is 180°, such that the reinforcing lines surround 50% of the outer perimeter.

In various embodiments, reinforcing lines can partially or fully surround an outer perimeter of a visual representation of branding by any integer angle of 1-360°, or by any range of any such angles. In various alternative embodiments, reinforcing lines can surround an outer perimeter of a visual representation of any graphic, by any integer angle of 1-360° (centered on the center of the visual representation), or by any range of any such angles. In other alternative embodiments, reinforcing lines can surround an outer perimeter of one or more raised areas by any integer angle from 1-360° (centered on the center of the one or more raised areas), or by any range of any such angles. As examples, reinforcing lines can surround such outer perimeters by angles of 1-181°, 1-109°, 1-190°, 1-75°, 1-73°, 1-37°, 1-19°, 1-10°, 10-181°, 19-109°, 37-73°, 10-360°, 19-360°, 37-360°, 73-360°, 109-360°, 181-360°, etc.

Figures 27A, 27B, 27C:
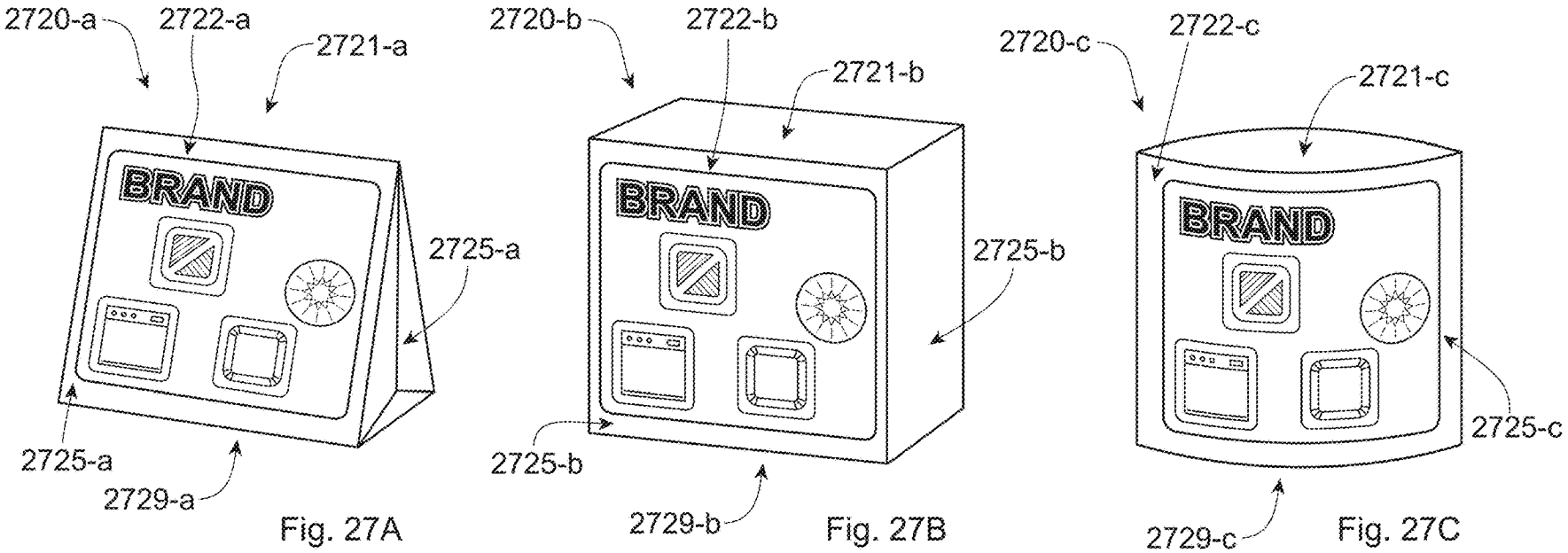
FIG. 27A illustrates a package with raised areas.
FIG. 27B illustrates various packages with raised areas.
FIG. 27C illustrates various packages with raised areas.

FIG. 27A illustrates a perspective view of a package 2720-*a*, having an overall shape similar to a triangular prism, standing upright on a horizontal support surface (not shown), wherein the package 2720-*a* includes a top 2721-*a*, a bottom 2729-*a*, and sides 2725-*a*, wherein one of the sides 2725-*a* has a panel 2722-*a*, which is the same as the panel 2222-*a* of FIG. 22A. In various embodiments, the panel 2222-*a* can be varied according to one or more of any alternative embodiments disclosed herein and the package 2720-*a* can be a flexible package or a rigid package, as described herein.

FIG. 27B illustrates a perspective view of a package 2720-*b*, having an overall shape similar to a cuboid, standing upright on a horizontal support surface (not shown), wherein the package 2720-*b* includes a top 2721-*b*, a bottom 2729-*b*, and sides 2725-*b*, wherein one of the sides 2725-*b* has a panel 2722-*b*, which is the same as the panel 2222-*a* of FIG. 22A. In various embodiments, the panel 2222-*b* can be varied according to one or more of any alternative embodiments disclosed herein and the package 2720-*b* can be a flexible package or a rigid package, as described herein.

FIG. 27C illustrates a perspective view of a package 2720-*c*, having an overall shape similar to an elliptical cylinder, standing upright on a horizontal support surface (not shown), wherein the package 2720-*c* includes a top 2721-*c*, a bottom 2729-*c*, and sides 2725-*c*, wherein one of the sides 2725-*c* has a panel 2722-*c*, which is the same as the panel 2322-*a* of FIG. 23A. In various embodiments, the panel 2222-*c* can be varied according to one or more of any alternative embodiments disclosed herein and the package 2720-*c* can be a flexible package or a rigid package, as described herein.

In various embodiments, any two, or all three, of the packages of FIGS. 27A, 27B, and 27C can be configured to form any line-up of packages described herein.

Figures 28A, 28B, 28C:
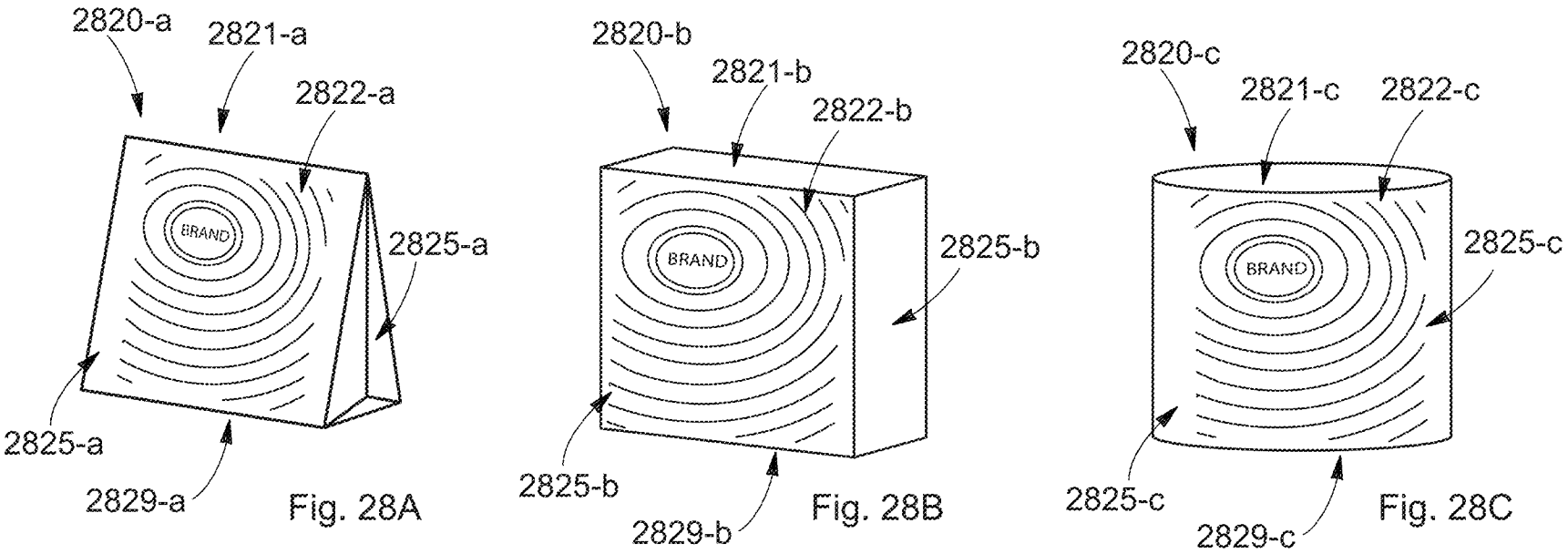
FIG. 28A_illustrates a package with raised reinforcing areas.
FIG. 28B illustrates a package with raised reinforcing areas.
FIG. 28C illustrates a package with raised reinforcing areas.

FIG. 28A illustrates a perspective view of a package 2820-*a*, having an overall shape similar to a triangular prism, standing upright on a horizontal support surface (not shown), wherein the package 2820-*a* includes a top 2821-*a*, a bottom 2829-*a*, and sides 2825-*a*, wherein one of the sides 2825-*a* has a panel 2822-*a*, which is a front panel, and the front panel is the same as the panel 2322-*a* of FIG. 23A. In various embodiments, the panel 2322-*a* can be varied according to one or more of any alternative embodiments disclosed herein and the package 2820-*a* can be a flexible package or a rigid package, as described herein.

FIG. 28B illustrates a perspective view of a package 2820-*b*, having an overall shape similar to a cuboid, standing upright on a horizontal support surface (not shown), wherein the package 2820-*b* includes a top 2821-*b*, a bottom 2829-*b*, and sides 2825-*b*, wherein one of the sides 2825-*b* has a panel 2822-*b*, which is a front panel, and the front panel is the same as the panel 2322-*a* of FIG. 23A. In various embodiments, the panel 2322-*b* can be varied according to one or more of any alternative embodiments disclosed herein and the package 2820-*b* can be a flexible package or a rigid package, as described herein.

FIG. 28C illustrates a perspective view of a package 2820-*c*, having an overall shape similar to an elliptical cylinder, standing upright on a horizontal support surface (not shown), wherein the package 2820-*c* includes a top 2821-*c*, a bottom 2829-*c*, and sides 2825-*c*, wherein one of the sides 2825-*c* has a panel 2822-*c*, which is a front panel, and the front panel is the same as the panel 2322-*a* of FIG. 23A. In various embodiments, the panel 2322-*c* can be varied according to one or more of any alternative embodiments disclosed herein and the package 2820-*c* can be a flexible package or a rigid package, as described herein.

In various embodiments, any two, or all three, of the packages of FIGS. 28A, 28B, and 28C can be configured to form any line-up of packages described herein.

Figure 29:
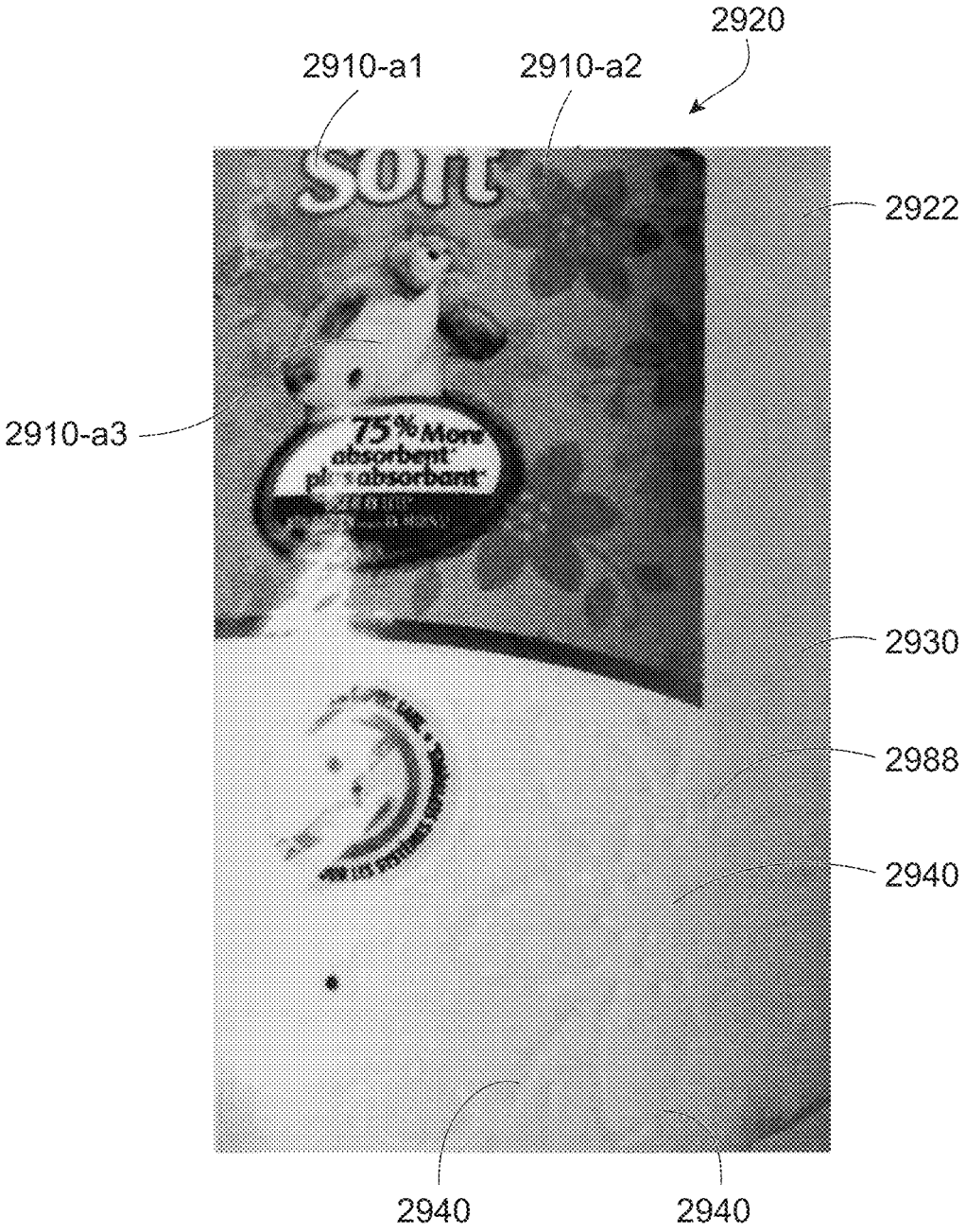
FIG. 29 is a photograph of packaging.

FIG. 29 illustrates a portion 2920 of a package for retail sale of a consumer product, which in FIG. 29 is a rolled tissue product, specifically, toilet tissue. In general, a tissue product can be packaged in roll form, or in flat, stacked configurations, such as for facial tissues or table napkins. Rolled tissue products are generally supplied as a perforated strip wound on a cardboard tube, and are commonly marketed as toilet tissue and paper towels. The package of FIG. 29 contains toilet tissue rolls 2930, each roll having wound thereon a perforated strip of toilet tissue having on a surface thereof a visible emboss pattern 2938 made up of a plurality of emboss elements 2940. The portion 2920 shown is a panel 2922 of flexible material having opaque regions and transparent regions. The opaque regions can be where external artwork is printed onto the flexible material. External artwork 2939 can include a number of visual representations including a brand name. In FIG. 29 a portion of a brand name CHARMIN ULTRA SOFT® is shown. The brand name can be fully or partially on a first raised portion 2910-*a*1 according to the present disclosure. The external artwork can also include a print representation of the emboss pattern 2938 of the rolled tissue product, which can be a second raised area 2910-*a*2 according to the present disclosure, and a trademark, i.e., the Charmin bear, which can be a third raised area 2910-*a*3 according to the present disclosure.

Figure 30:
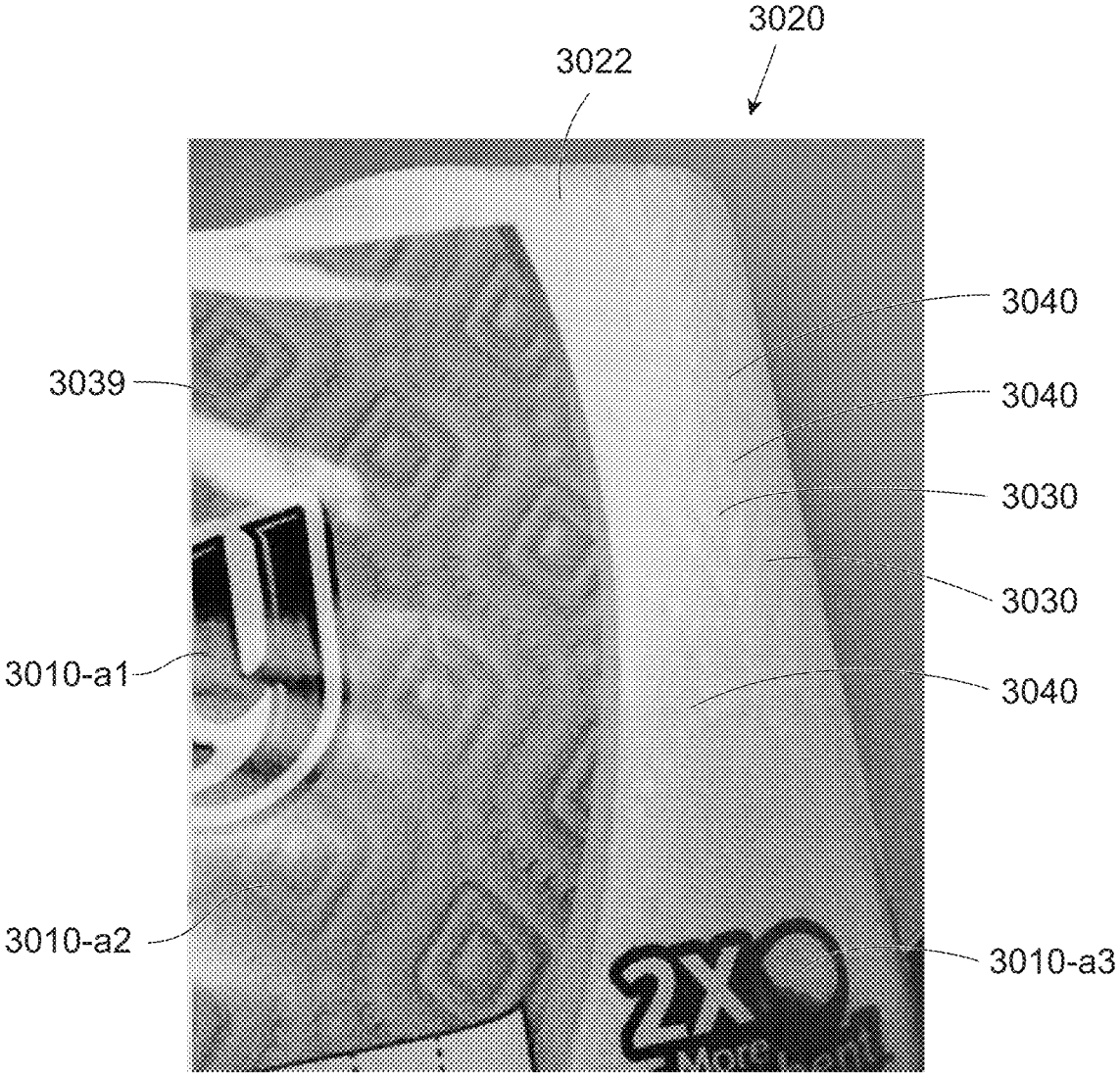
FIG. 30 is a photograph of a packaging.

FIG. 30 illustrates a portion 3020 of a package for retail sale of a consumer product, which in FIG. 30 is a rolled tissue product, specifically, paper towels. The package of FIG. 30 contains at least one paper towel roll 3030, each roll having wound thereon a perforated strip of absorbent tissue having on a surface thereof a visible emboss pattern 3038 made up of a plurality of emboss elements 3040. The portion 3020 shown is a panel 3022 of flexible material having opaque regions and transparent regions. The opaque regions can be where external artwork is printed onto the flexible material. External artwork 3039 can include a number of visual representations including a brand name. A portion of a brand name BOUNTY® is shown, and can be a first raised portion 3010-*a*1 according to the present disclosure. The external artwork can also include a print representation of the emboss pattern 3038 of the rolled tissue product, which can be a second raised area 3010-*a*2 according to the present disclosure, and a trademark, which can be a third raised area 3010-*a*3 according to the present disclosure.

As discussed above, for packages of the type shown in FIGS. 29 and 30, panel 2922 or 3022 can have opaque portions and transparent portions. As shown, the printed area of visual representations can be opaque, and the non-printed portions can be transparent such that the product, e.g., toilet tissue or paper towel, can be seen through the flexible material. In this manner, the consumer can actually see the emboss pattern or other visible product features of the packaged product. By having external artwork that includes features in the form of printed raised portions, the consumer can have the visible impression of the product reinforced by a visual and tactile impression of the emboss pattern or other visible product features on the package itself. In an embodiment, the graphic of the emboss pattern on the external artwork can be substantially identical in visual impression to the actual emboss pattern on the packaged product. By substantially identical is meant that an ordinary observer viewing the package at the point of sale would recognize that the pattern of the graphic representation on the external artwork appears to be the same as the pattern of emboss on the packaged product. In an embodiment, the graphic of the emboss pattern on the external artwork can be substantially similar in visual impression to the actual emboss pattern on the packaged product. By substantially similar is meant that an ordinary observer viewing the package at the point of sale would recognize that the pattern of the graphic representation on the external artwork appears similar to the pattern of emboss on the packaged product. In an embodiment, the graphic of the emboss pattern on the external artwork can be of one or more of the emboss elements making up the emboss pattern, to give a visual impression approximate to that of the actual emboss pattern on the packaged product.

Emboss patterns on tissue products can be made by any method known in the art. Emboss patterns can be designed to strengthen the brand equity of the tissue product's brand. For this reason having the emboss pattern of the tissue product visible through the flexible member as well as having a substantially identical or similar raised pattern printed on opaque portions reinforces to the purchasing consumer certain value for the packaged product. For example, for the toilet tissue shown in FIG. 29, an embossed pattern 2938 of relatively large flower shapes communicates softness to the user. By including in the panel 2922 a transparent portion of the flexible packaging, the emboss pattern 2938 on the surface of the toilet tissue can be seen through the flexible packaging. Further, by having the identical or similar raised pattern printed on the opaque portion of the external artwork 2939 of flexible packaging, the brand equity-building emboss pattern can be visually appreciated, and in the case that the printed pattern is on a raised area, can be tactilely experienced by the user.

Likewise, for the paper towels shown in FIG. 30, an embossed pattern 3038 of diamond shapes and wavy line shapes communicates strength and absorbency to the user. By including in the portion 3020 a transparent portion of the flexible packaging, the emboss pattern 3038 on the surface of the paper towel can be seen through the flexible packaging. Further, by having the identical or similar raised pattern printed on the opaque portion of the portion 3039 of flexible packaging, the brand equity-building emboss pattern can be visually appreciated, and in the case that the printed pattern is on a raised area, can be tactilely experienced by the user.

Any of the raised areas and/or raised reinforcing lines disclosed herein can be made from one or more curable coatings, including photopolymers such as mixtures of monomers, oligomers, and/or photoinitiators; common forms include acrylates and silicones; such photopolymers are curable into a hardened state by exposure to heat and/or light (visible and/or ultraviolet), as known in the art. In various alternative embodiments, any of the raised areas and/or raised reinforcing lines disclosed herein can made from various polymers, such as thermoplastics and/or thermosets. Any of the raised areas and/or raised reinforcing lines disclosed herein can be disposed on a flexible packaging material (or flexible label) by any suitable process for applying such print/coatings, such as: gravure printing, inkjet printing, screen printing, and flexographic printing, or any other suitable process known in the art; these processes can also be used to impart a smooth outer surface or a rough/textured outer surface to an of the raised areas and/or raised reinforcing lines described herein. Any of the raised areas and/or raised reinforcing lines disclosed herein can be disposed on a rigid package by applying a printed label or overwrap, or in the case of a molded rigid container by adding the raised areas and/or raised reinforcing lines to the shape of the mold that forms the external surface of the rigid container.

Any of the embodiments herein can be modified by replacing a single raised area with one or more raised areas having a same or similar structure and/or function as part, parts, or all of the single raised area. Any of the embodiments herein can be modified by replacing a particular visual representation with any other visual representation of graphics described herein or known in the art, such that the other visual representation has a same or similar association with its corresponding raised area. Any of the embodiments herein can be modified such that only part or parts of the raised area are used and/or only part or parts of the visual representations are used.

As described above, packages of the present disclosure provide improvements in displaying graphics. Packages with raised areas can make graphics more noticeable, can more accurately portray the consumer products inside of opaque packages, and can better emphasize similarities and differences between product offerings. Packages with raised reinforcing lines can at least assist in reducing bending and/or wrinkling on flexible packages, and can also be used to draw further attention to graphics, such as images and branding.

While the figures of the present application are black and white line drawings, any form of color, shading, and/or patterning can be applied and used with any of the embodiments described herein.

Definitions

As used herein, the term "about" modifies a particular value, by referring to a range equal to the particular value, plus or minus twenty percent (+/−20%). For any of the embodiments disclosed herein, any disclosure of a particular value, can, in various alternate embodiments, also be understood as a disclosure of a range equal to about that particular value (i.e. +/−20%).

As used herein, the term "approximately" modifies a particular value, by referring to a range equal to the particular value, plus or minus fifteen percent (+/−15%). For any of the embodiments disclosed herein, any disclosure of a particular value, can, in various alternate embodiments, also be understood as a disclosure of a range equal to approximately that particular value (i.e. +/−15%).

As used herein, the term "branding" refers to a kind of graphic intended to distinguish a product from other products. Examples of branding include one of more of any of the following: trademarks and/or trade dress such as logos, icons, symbols, and the like. For any embodiment disclosed herein (including any alternative embodiments), any surface of the package, including any raised area(s), can include one or more brandings of any size, shape, or configuration, disclosed herein or known in the art, in any combination.

As used herein, the term "flexible package" refers to a package, wherein one or more flexible materials form 50-100% of the total mass of the package, or any integer value for percentage from 50-100%, or any range formed by any of these values. As examples, for a flexible package, one or more flexible materials may form 60-100%, or 70-100%, or 80-100%, or 90-100% of the total mass of the package. Any of the packages described herein may be a flexible package, or may be a rigid package (such as a package made out of glass, metal, rigid plastic, or cardboard).

As used herein, the term "flexible material" refers to a thin, easily deformable, sheet-like material, having a flexibility factor within the range of 1,000-2,500,000 N/m. As examples, a flexible material may have a flexibility factor of 1,000-1,250,500 N/m, 1,000-750,700 N/m, 1,000-500,800 N/m, 1,000-250,900 N/m, 1,000-63,475 N/m, 1,000-25,990 N/m, 1,000-13,495 N/m, 13,495-1,250,500 N/m, 25,990-750,700 N/m, 63,475-500,800 N/m, 125,950-250-900 N/m, 13,495-2,500,000 N/m, 12,990-2,500,000 N/m, 63,475-2,500,000 N/m, 125,950-2,500,000 N/m, 250,900-2,500,000 N/m, 500,800-2,500,000 N/m, 750,700-2,500,000 N/m, 1,250,500-2,500,000 N/m, etc. Examples of materials that can be flexible materials include one or more of any of the following: films (such as plastic films), elastomers, foamed sheets, foils, fabrics (including wovens and nonwovens), biosourced materials, and papers, in any configuration, as separate material(s), or as layer(s) of a laminate, or as part(s) of a composite material, in a microlayered or nanolayered structure, with or without one or more of any suitable additives (such as perfumes, dyes, pigments, particles, agents, actives, fillers (e.g. fibers, reinforcing structures), etc.) and in any combination, as described herein or as known in the art.

As used herein, the term "flexibility factor" refers to a material parameter for a thin, easily deformable, sheet-like material, wherein the parameter is measured in Newtons per meter, and the flexibility factor is equal to the product of the value for the Young's modulus of the material (measured in Pascals) and the value for the overall thickness of the material (measured in meters).

As used herein, the term "graphic" refers to a visual representation of an element intended to provide a decoration or to communicate information. Examples of graphics include one or more of any of the following: colors, patterns, designs, images (e.g. photographs, drawings, or other renderings), characters, branding, and the like. For any embodiment disclosed herein (including any alternative embodiments), any surface of the package, including any raised area(s), can include one or more graphics of any size, shape, or configuration, disclosed herein or known in the art, in any combination.

As used herein, the term "like-numbered" refers to similar alphanumeric labels for corresponding elements, as described below. Like-numbered elements have labels with the same last two digits; for example, one element with a label ending in the digits 20 and another element with a label ending in the digits 20 are like-numbered. Like-numbered elements can have labels with differing leading digit(s), wherein that leading digit(s) matches the number for its FIG.; as an example, an element of FIG. 3 labeled 320 and an element of FIG. 4 labeled 420 are like-numbered. Like-numbered elements can have labels with a suffix (i.e. the portion of the label following the dash symbol) that is the same or possibly different (e.g. corresponding with a particular embodiment); for example, a first embodiment of an element in FIG. 3A labeled 320-*a* and a second embodiment of an element in FIG. 3B labeled 320-*b*, are like numbered.

As used herein, when referring to a raised reinforcing line the term "line" refers to a raised portion having an overall pathway length that is at least ten (10) times its widest overall width along that pathway length. Part, parts, or all of any raised reinforcing line can be straight, curved, angled, segmented, or other shapes, or any combination or any of these. In various embodiments, a raised reinforcing line can be formed by a unitary, continuous pathway or can be approximated by a number of discrete and/or separate raised portions disposed in series along a pathway.

As used herein, when referring to a line-up of packages the term "line-up" refers to a group of two or more packages, each having a particular configuration that is unique within the group, and each made by and/or offered by a single person, organization, or business entity. The line-up can include any number of packages such as two, three, four, five, six, seven, eight, nine, ten, or more packages. The uniqueness of the particular configurations may result from differences between the packages and/or differences between the products in the packages. In various embodiments of a line-up of packages, one or more of the packages may have graphics, raised areas, and/or raised reinforcing lines that are the same as, similar to, or different from the graphics, raised areas, and/or raised reinforcing lines on one, or some, or all of the other packages in the line-up. Any of the packages disclosed herein (including any alternative embodiments) can be used in any workable combination form a line-up of packages.

As used herein, the term "nearly" modifies a particular value, by referring to a range equal to the particular value, plus or minus five percent (+/−5%). For any of the embodiments disclosed herein, any disclosure of a particular value, can, in various alternate embodiments, also be understood as a disclosure of a range equal to approximately that particular value (i.e. +/−5%).

As used herein, the term "opaque" refers to a material that cannot be seen through by ordinary human vision. For any of the packages described herein, part, parts, or all of any portion and/or panel (including top, sides, and/or bottom) of the package may be opaque or partially transparent or fully transparent, in any workable combination. In various embodiments of any package described herein, part, parts, or all of the package may be opaque such that part, parts, or all of one, or some, or all of the consumer products contained within the package cannot be seen from outside of the package when the package is standing upright on a horizontal support surface.

As used herein, the term "panel of flexible material" refers to a portion of an outside surface of a flexible package, wherein the portion is bounded by folds, curves, seams, and/or edges, such that the bounded portion is configured to substantially face a particular overall direction. Any of the embodiments of raised areas and/or raised reinforcing lines can be disposed on one or more of any panels of any package disclosed herein or known in the art, including a front panel, a back panel, a side panel, and top panel, and a bottom panel.

As used herein, the term "reinforcing area" refers to an area on a package, over which a plurality of raised reinforcing lines extends, wherein the boundary for this area is determined by drawing a continuous series of straight-line connections between the farthest outer extents of the raised reinforcing lines to from a boundary around the smallest possible area; if a reinforcing area is defined or described with respect to a panel, then the outer extents of the raised reinforcing lines are considered to be limited to their extents on that panel. For any of the embodiments disclosed herein, when a plurality of raised reinforcing lines are disposed on a panel of a package, the plurality of raised reinforcing lines can extend over a reinforcing area that is 35-100% of a total area of the panel, or any integer value for percentage from 35-100, or any range formed by any of these values. As examples, a plurality of raised reinforcing lines can extend over a reinforcing area that is 35-90%, 35-80%, 35-70%, 35-60%, 35-50%, 35-40%, 40-90%, 50-80%, 60-70%, 40-100%, 50-100%, 60-100%, 70-100%, 75-100%, 80-100%, or 90-100% of a total area of the panel.

As used herein, when referring to a packages for retail sale, the term "configured for retail sale" refers to a package that is fully manufactured and its product space(s) is/are filled with product(s) and the package is fully closed and/or sealed and the package is in condition to be purchased by an end user (e.g. a consumer), through any sales and/or distribution channel, wherein the package has not been opened or unsealed, and wherein the product(s) in the package have not been put into its/their intended end use. Any package disclosed herein (including any alternative embodiments) can be configured for retail sale.

As used herein, the term "substantially" modifies a particular value, by referring to a range equal to the particular value, plus or minus ten percent (+/−10%). For any of the embodiments disclosed herein, any disclosure of a particular value, can, in various alternate embodiments, also be understood as a disclosure of a range equal to approximately that particular value (i.e. +/−10%).

As used herein, when referring to a plurality of raised reinforcing lines, the term "total line area" refers to the sum of all of the areas on a package, which are covered by the footprint of the raised reinforcing lines in the plurality; if a total line area is defined or described with respect to a panel, then the portions of the raised reinforcing lines used in the sum are the portions that are disposed on that panel. For example, if a plurality of raised reinforcing lines has 10 straight lines, each having an overall width of 500 microns (0.05 centimeters) and an overall pathway length of 10 centimeters, then the total line area would be the product of the overall width (0.05 centimeters) and the overall length (10 centimeters) and the number of lines, which yields 5 square centimeters. For any of the embodiments disclosed herein, when a plurality of raised reinforcing lines are disposed on a panel of a package, the plurality of raised reinforcing lines can extend over a total line area that is 1-35% of a total area of the panel, or any integer value for percentage from 1-35, or any range formed by any of these values. As examples, a plurality of raised reinforcing lines can extend over a total line area that is 1-35%, 1-30%, 1-25%, 1-20%, 1-15%, 1-10%, 1-5%, 5-30%, 10-25%, 15-20%, 5-35%, 10-35%, 15-35%, 20-35%, or 30-35% of a total area of the panel.

The packages described herein, may be used across a variety of industries for a variety of products. For example, any embodiment of a package, as described herein may be used for receiving, containing, storing, and/or dispensing any fluent product in the consumer products industry, including any of the following products, any of which can take any product form described herein or known in the art: baby care products (e.g. soaps, shampoos, and lotions); beauty care products for cleaning, treating, beautifying, and/or decorating human hair (e.g. hair shampoos, hair conditioners, hair dyes, hair colorants, hair repair products, hair growth products, hair removal products, hair minimization products, etc.); beauty care products for cleaning, treating, beautifying, and/or decorating human skin (e.g. soaps, body washes, body scrubs, facial cleansers, astringents, sunscreens, sun block lotions, lip balms, cosmetics, skin conditioners, cold creams, skin moisturizers, antiperspirants, deodorants, etc.); beauty care products for cleaning, treating, beautifying, and/or decorating human nails (e.g. nail polishes, nail polish removers, etc.); grooming products for cleaning, treating, beautifying, and/or decorating human facial hair (e.g. shaving products, pre-shaving products, after shaving products, etc.); health care products for cleaning, treating, beautifying, and/or decorating human oral cavities (e.g. toothpaste, mouthwash, breath freshening products, anti-plaque products, tooth whitening products, etc.); health care products for treating human health conditions (e.g. medicines, medicaments, pharmaceuticals, vitamins, nutraceuticals, nutrient supplements (for calcium, fiber, etc.), cough treatment products, cold remedies, lozenges, treatments for respiratory and/or allergy conditions, pain relievers, sleep aids, gastrointestinal treatment products (for heartburn, upset stomach, diarrhea, irritable bowel syndrome, etc.), purified water, treated water, etc.); fabric care products for cleaning, conditioning, refreshing and/or treating fabrics, clothes, and/or laundry (e.g. laundry detergents, fabric conditioners, fabric dyes, fabric bleaches, etc.); dish care products for home, commercial, and/or industrial use (e.g. dish soaps and rinse aids for hand-washing and/or machine washing); cleaning and/or deodorizing products for home, commercial, and/or industrial use (e.g. soft surface cleaners, hard surface cleaners, glass cleaners, ceramic tile cleaners, carpet cleaners, wood cleaners, multi-surface cleaners, surface disinfectants, kitchen cleaners, bath cleaners (e.g. sink, toilet, tub, and/or shower cleaners), appliance cleaning products, appliance treatment products, car cleaning products, car deodorizing products, air cleaners, air deodorizers, air disinfectants, etc.), and the like.

Any embodiment of flexible containers, as described herein, can also be used for receiving, containing, storing, and/or dispensing, any non-fluent product in the consumer products industry, including any of the following products, any of which can take the product form of discrete articles, as known in the art: Baby Care products, including disposable wearable absorbent articles, diapers, training pants, infant and toddler care wipes, etc. and the like; Beauty Care products including applicators for applying compositions to human or animal hair, skin, and/or nails, etc. and the like; Home Care products including wipes and scrubbers for all kinds of cleaning applications and the like; Family Care products including wet or dry bath tissue, facial tissue, disposable handkerchiefs, disposable towels, wipes, etc. and the like; Feminine Care products including catamenial pads, incontinence pads, interlabial pads, panty liners, pessaries, sanitary napkins, tampons, tampon applicators, wipes, etc. and the like; Health Care products including oral care products such as oral cleaning devices, dental floss, flossing devices, toothbrushes, etc. and the like.

Although the present disclosure describes its embodiments with respect to consumer products, they can also be similarly applied outside of the consumer products industry.

The present disclosure particularly contemplates the embodiments set forth in the following paragraphs A through F:

A. A flexible package with one or more of any embodiment of graphics disposed on raised areas, as disclosed herein.

B. A flexible package, with one or more of any embodiment of raised reinforcing lines, as disclosed herein.

C. A line-up of any kind of packages disclosed herein, including the flexible package according to paragraph A or B.

D. The line-up of paragraph C including a rigid package with one or more of any embodiment of graphics disposed on raised areas, as disclosed herein.

E. The line-up of packages according to paragraph C or D, wherein the flexible package and the rigid package have the same or similar branding but contain different consumer products.

F. The line-up of packages according to paragraph C or D, wherein the flexible package and the rigid package have the same or similar branding but contain different forms of the same consumer products.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

The invention claimed is:

1. A flexible package for retail sale of a rolled tissue product, the flexible package comprising:

a flexible film; and one or more raised areas comprising a first raised area having an overall height of 288-5000 microns, disposed on an outside of the flexible film;

wherein:

the flexible package contains the rolled tissue product, the rolled tissue product comprising on a surface thereof a visible pattern of embossing;

portions of the flexible package are transparent sufficient to see the visible pattern of embossing of the rolled tissue product;

portions of the flexible package are opaque, such that portions of the rolled tissue product cannot be seen from outside of the flexible package;

the opaque portions of the flexible package comprise external artwork comprising a graphic substantially identical to the pattern of embossing on the rolled tissue product;

the flexible package is formed of only the flexible film and the one or more raised areas;

the one or more raised areas are separate elements from the flexible film and are not formed from a portion of the flexible film;

and at least part of the graphic is disposed on the first raised area.

2. The flexible package of claim 1, wherein at least part of an overall shape of the first raised area is geometrically similar to at least part of an overall shape of the graphic.

3. The flexible package of claim 1, wherein substantially all of the graphic is disposed on the first raised area, and wherein the first raised area comprises one or more curable coatings.

4. The flexible package of claim 3, wherein an overall shape of the first raised area is geometrically similar to an overall shape of the graphic.

5. The flexible package of claim 3, wherein an overall shape of the first raised area conforms to an overall shape of the graphic.

6. The flexible package of claim 1, wherein:
the external artwork comprises branding;
the one or more raised areas further comprise a second raised area having an overall height of 288-5000 microns and disposed on the outside of the flexible film; and
at least a portion of the branding is associated with the second raised area.

7. The flexible package of claim 1, wherein a portion of the first raised area is comprised of one or more raised reinforcing lines that are configured to reduce at least one of bending or wrinkling of the flexible package.

8. The flexible package of claim 1, wherein a first portion of the first raised area is relatively taller than a relatively shorter second portion of the first raised area, and wherein such first portion is 1% to 1000% taller than the second portion.

9. A flexible package for a tissue product, the flexible package comprising:
a flexible film; and
a raised area having an overall height of 40-5000 microns, disposed on an outside of the flexible film;
wherein:
the flexible package is formed of only the flexible film and the raised area;
the flexible package contains the tissue product, the tissue product comprising on a surface thereof a visible pattern of embossing;
portions of the flexible package comprise external artwork that includes a graphic substantially similar to the pattern of embossing;
the raised area is a separate element from the flexible film and is not formed from a portion of the flexible film;
at least part of the graphic is disposed on the raised area; and
the raised area comprises a first planar portion with a first height and a second planar portion with a second height that is different from the first height.

10. The flexible package of claim 9, wherein at least part of an overall shape of the raised area is geometrically similar to at least part of an overall shape of the graphic of the flexible package.

11. The flexible package of claim 9, wherein substantially all of the graphic is disposed on the raised area, and wherein the raised area comprises one or more curable coatings.

12. The flexible package of claim 9, wherein an overall shape of the raised area is geometrically similar to the pattern of embossing or conforms to an overall shape of the pattern of embossing.

13. The flexible package of claim 9, wherein the first planar portion comprises an outer portion of the raised area, the second planar portion comprises an inner portion of the raised area, and the graphic is at least partially disposed on the second planar portion.

14. The flexible package of claim 13, wherein the graphic is fully disposed on the second planar portion and an overall outer shape of the inner portion is geometrically similar to an overall outer shape of the graphic.

15. A flexible package for a tissue product, the flexible package comprising:
a flexible film;
a first raised area having an overall height of 164-5000 microns, disposed on an outside of the flexible film; and
a second raised area having an overall height of 164-5000 microns, disposed on an outside of the flexible film;
wherein:
the flexible package is formed of only the flexible film, the first raised area, and the second raised area;
the first raised area and the second raised area are separate elements from the flexible film and are not formed from portions of the flexible film;
the second raised area comprises one or more raised reinforcing lines that are separate from and at least partially surround the first raised area, the one or more raised reinforcing lines being configured to reduce at least one of bending or wrinkling of the flexible package;
the flexible package contains the tissue product, the tissue product comprising on a surface thereof a visible pattern of embossing;
portions of the flexible package comprise external artwork that includes:
a first graphic having a visual appearance substantially identical to the visual appearance of a portion of the pattern of embossing; and
a second graphic, wherein at least a part of the first graphic and at least a part of the second graphic are associated with at least one of the first raised area or the second raised area.

16. The flexible package of claim 15, wherein:
portions of the package are opaque, such that the tissue product cannot be seen from outside of the flexible package when the flexible package is on a horizontal support surface;
the first graphic is associated with the opaque portion; and
the tissue product is selected from the group consisting of facial tissue, table napkins, toilet tissue, and paper towels.

17. The flexible package of claim 15, wherein the first raised area and the second raised area comprise one or more curable coatings.

18. The flexible package of claim 15, wherein the first raised area and the second raised area are different heights.

19. The flexible package of claim 15, wherein at least one of the one or more raised reinforcing lines fully surrounds the first raised area.

20. The flexible package of claim 15, wherein an overall shape defined by the one or more raised reinforcing lines is geometrically similar to an overall outer shape of the first raised area.

* * * * *